US005288597A

United States Patent [19]

Hayashi

[11] Patent Number: 5,288,597

[45] Date of Patent: Feb. 22, 1994

[54] METHOD FOR FORMING A COLOR IMAGE

[75] Inventor: Yasuhiro Hayashi, Kanagawa, Japan

[73] Assignee: Fuji Photo Film Co., Ltd., Kanagawa, Japan

[21] Appl. No.: 71,024

[22] Filed: Jun. 3, 1993

Related U.S. Application Data

[63] Continuation of Ser. No. 650,491, Feb. 5, 1991, abandoned.

[30] Foreign Application Priority Data

Feb. 5, 1990 [JP] Japan ..... 2-25510

[51] Int. Cl.[5] ..... G03C 7/407

[52] U.S. Cl. ..... 430/448; 430/386; 430/387; 430/607; 430/611; 430/613

[58] Field of Search ..... 430/374, 382, 386, 387, 430/390, 391, 415, 443, 448, 544, 551, 559, 601, 603, 607, 610, 611, 957, 958

[56] References Cited

U.S. PATENT DOCUMENTS

| | | | |
|---|---|---|---|
| 5,043,256 | 8/1991 | Otani | 430/551 |
| 5,047,315 | 9/1991 | Morigaki et al. | 430/551 |
| 5,068,171 | 11/1991 | Morigaki et al. | 430/551 |
| 5,126,234 | 6/1992 | Naruse et al. | 430/387 |
| 5,202,229 | 4/1993 | Kuse et al. | 430/387 |

*Primary Examiner*—Hoa V. Le

*Attorney, Agent, or Firm*—Sughrue, Mion, Zinn, Macpeak & Seas

[57] ABSTRACT

A method of forming a color image which comprises providing a silver halide color photographic material including a support having thereon at least one photosensitive layer containing at least one coupler which forms a dye upon a coupling reaction with an oxidized product of an aromatic primary amine color developing agent and a substantially silver iodide-free silver halide emulsion containing at least 90 mol. % of silver chloride, which silver halide color photographic material further contains at least one compound of the following formula (I) or (II), and subjecting said silver halide color photographic material to imagewise exposure and then to development with a substantially benzyl alcohol-free developer for not less than 90 seconds.

$$R_{21}\text{-}(A)_n\text{-}X \quad \text{(I)}$$

$$R_{22}\text{-}\underset{\underset{B}{|}}{C}=Y_1 \quad \text{(II)}$$

9 Claims, No Drawings

METHOD FOR FORMING A COLOR IMAGE

This is a continuation of application Ser. No. 07/650,491 filed Feb. 5, 1991, now abandoned.

FIELD OF THE INVENTION

The present invention relates to a method of forming an image in a silver halide color photographic material and. In particular, the present invention relates to a method for forming a color image characterized by a marked reduction in pollution load due to processing waste liquor, a stable image quality even during storage after exposure, and resistance to stain that may occur after development.

BACKGROUND OF THE INVENTION

The increased use of color photographic light-sensitive materials has been accompanied by a steady increase in color development processing load. As a consequence, an effective reduction of pollution due to processing waste liquor and increased processing speed are currently in great demand.

Processing of color photosensitive materials generally consists of color development, bleaching and fixing or bleach-fixing, and rinsing and/or image stabilization. Intensive research for meeting the above demand led to the discovery that the pollution load due to processing waste liquor could be reduced by removing benzyl alcohol, a substance which is high in both BOD (biological oxygen demand) and COD (chemical oxygen demand) from the color developing bath while compensating for the resulting marked loss of development speed by using silver chloride-rich grains in the silver halide emulsion layers of the color photographic material to thereby increase the intrinsic development speed of the emulsion. These innovations are described in, for example, Laid-open International Patent WO 87-04534 and JP-A-62-269957 and JP-A-64-26837 (the term "JP-A" as used herein refers to a "published unexamined Japanese patent application").

An effective approach to hastening silver removal is to reduce the silver coverage of the photosensitive material. As a corollary, it is preferable to use 2-equivalent couplers rather than 4-equivalent couplers and more preferable to use couplers with high color developing properties. This approach has also been studied previously.

Referring to the washing and/or image stabilizing process, attempts have been made to shorten the processing time or reduce the rate of replenishment or refill for reduced pollution loads. However, as a consequence of these efforts, a problem has emerged in that stains develop during storage of the photosensitive material which mar the white background and color image. This condition is attributed to residues of the developing agent in the processed photosensitive material, which react with the residual unreacted couplers to produce stains.

Particularly, a photosensitive material adapted for rapid processing can be developed by using conventional non-rapid automatic developing equipment but alloting more time than usual to processing. This practice does not involve a new capital investment and, as such, is advantageous to users (when the process is carried out over a considerably long time, the processing temperature is sometimes lowered) but a marked degree of stain inevitably develops during storage.

The color print photosensitive material of the type that color photographs are viewed by transmitted light demands an increased emulsion coverage to insure sufficient color density but this results in a decrease in development speed and a prolonged developing time. Even when using this technique, marked staining is a major problem.

To correct these problems, several techniques have been developed for inhibiting the residual developing agent. These techniques are described in, for example, the specifications of JP-A-63-158545 and JP-A-64-86139.

However, the present inventors have found that when a silver halide color photographic material is made using the stain inhibitor described in the aforesaid patent literature, and a silver chloride-rich emulsion is developed with a color developer substantially free of benzyl alcohol, desensitization occurs during storage of the photosensitive material after exposure, although a marked inhibition of stain was attained. This indicates that this photographic material does not insure a stable image and has a serious drawback from a commercial standpoint.

SUMMARY OF THE INVENTION

An object of the present invention is to provide a method of forming a color image in a silver halide color photosensitive material which employs processing solutions with a reduced waste liquor pollution load, is able to yield a stable color image even during storage of the exposed material, and is further able to produce a color image with inhibited postdevelopment stain.

A further object of the present invention is to provide a method of forming such a color image in a color print photosensitive material.

The intensive research by the present inventors led to the discovery that the above and other objects can be effectively attained by a method of forming a color image which comprises providing a silver halide color photographic material having on a support, at least one photosensitive layer containing at least one coupler which forms a dye on reaction with an oxidized product of an aromatic primary amine developing agent and a silver halide emulsion substantially free from silver iodide and containing not less than 90 mol. % of silver chloride, which silver halide color photosensitive material further contains at least one compound of formula (I) or (II) described below and, after imagewise exposure to light, developing the resulting latent image with a color developer substantially free from benzyl alcohol over a time period not less than 90 seconds.

It was further found that the above mentioned object can be more effectively accomplished by a method of forming a color image wherein the above silver halide color photographic material also contains at least one compound having the following formula (III) and is image-wise exposed to light and then developed with a color developer substantially free from benzyl alcohol for a time period of not less than 90 seconds.

$$R_{21}\text{-}(A)_n\text{-}X \qquad \text{(I)}$$

$$R_{22}\text{-}\underset{\underset{B}{|}}{C}=Y_1 \qquad \text{(II)}$$

In formulas (I) and (II), $R_{21}$ and $R_{22}$ each represents an aliphatic group, an aromatic group or a heterocyclic group; X represents a group which leaves on reaction with an aromatic amine developing agent; A represents a group which reacts with the aromatic amine developing agent to form a chemical bond; n is equal to 0 or 1; B represents hydrogen, an aliphatic group, an aromatic group, a heterocyclic group, an acyl group or a sulfonyl group; $Y_1$ represents a group which promotes addition of an aromatic amine developing agent to the compound of formula (II); and $R_{21}$ and X, and $Y_1$ and either $R_{22}$ or B may each be combined to form a ring structure.

$$R_{30}—Z \qquad \text{(III)}$$

In formula (III), $R_{30}$ represents an aliphatic group, an aromatic group or a heterocyclic group; Z represents a nucleophilic group or a group which is decomposed in the photosensitive material to release a nucleophilic group.

DETAILED DESCRIPTION OF THE INVENTION

In the present invention preferably the silver halide color photographic material has a total silver coverage of not less than 1.2 g/m$^2$. An upper limit of the total coverage is not particularly limited but preferably it is 4.0 g/m$^2$ from the viewpoint of a cost.

The compounds of formulas (I), (II) and (III) will now be described in further detail.

The compounds of formulas (I) and (II) are preferably compounds whose second-order reaction rate constant $K_2$ (80° C.) with respect to p-anisidine as determined by the method described in JP-A-63-158545 is within the range of 1.0 liter/mol.sec. to $1\times10^{-5}$ liter/mol.sec. On the other hand, the compound of formula (III) is preferably a compound in which Z is a group derived from a nucleophilic functional group whose Pearson nucleophilicity $^{n}CH_3I$ value (R. G. Pearson, et al., J. Am. Chem. Soc., 90, 319 (1968)) is not less than 5.

Among the compounds of formulas (I) to (III), the combination of a compound (I) or (II) with a compound (III) is preferable.

The respective groups in the compounds of formulas (I), (II) and (III) will now be described in further detail.

The aliphatic group, denoted by $R_{21}$, $R_{22}$, B and $R_{30}$, can be a straight chain, branched or cyclic alkyl, alkenyl or alkynyl group, which may be further substituted. The aromatic group, denoted by $R_{21}$, $R_{23}$, B and $R_{30}$, can be either a carbocyclic aromatic group (e.g., phenyl and naphthyl) or a hetero aromatic group (e.g., furyl, thienyl, pyrazolyl, pyridyl and indolyl) or may be a monocyclic group or a condensed cyclic group (e.g., benzofuryl and phenanthridinyl). Furthermore, their aromatic rings may be substituted.

The heterocyclic group, denoted by $R_{21}$, $R_{22}$, B and $R_{30}$, is preferably a 3- to 10-membered ring structure which includes oxygen, nitrogen and/or sulfur as the hetero atom or atoms, and this heterocycle may be saturated or unsaturated and may be further substituted (e.g., chromanyl, pyrrolidyl, pyrrolinyl and morpholinyl).

In formula (I), X represents a leaving group which is cleaved on reaction with an aromatic amine developing agent and is preferably an oxygen atom, a sulfur atom, a nitrogen atom, a group attached to A through an oxygen, sulfur or nitrogen atom (e.g., 2-pyridyloxy, 2-pyrimidyloxy, 4-pyrimidyloxy, 2-(1,2,3-triazin)oxy, 2-benzimidazolyl, 2-imidazolyl, 2-thiazoyl, 2-benzothiazolyl, 2-furyloxy, 2-thiophenyloxy, 2-pyridyloxy, 3-isoxazolyloxy, 3-pyrazolidinyloxy, 3-oxo-2-pyrazolonyl, 2-oxo-1-pyridinyl, 4-oxo-1-pyridinyl, 1-benzimidazolyl, 3-pyrazolyloxy, 3H-1,2,4-oxadiazolin-5-oxy, aryloxy, alkoxy, alkylthio, arylthio, substituted N-oxy, etc.) or a halogen atom. When X is a halogen atom, n is equal to 0.

Referring, further, to formula (I), A represents a group which forms a chemical bond on reaction with an aromatic amine developing agent, including low electron density groups such as

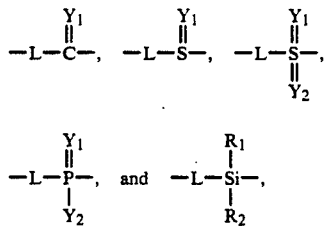

wherein L represents a single bond, an alkylene group,

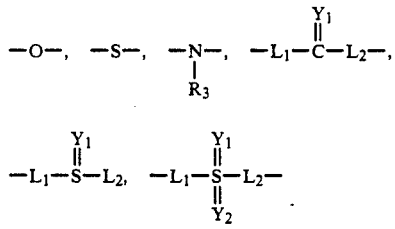

(e.g., carbonyl, sulfonyl, sulfinyl, oxycarbonyl, phosphonyl, thiocarbonyl, aminocarbonyl, silyloxy, etc.).

$Y_1$ in the above A groups has the same meaning as $Y_1$ in formula (II) and $Y_2$ in the above A groups has the same meaning as $Y_1$ in formula (II).

$R_1$ and $R_2$ may be the same or different and each represents $—L_3—R_{21}$. $R_3$ represents a hydrogen atom, an aliphatic group (e.g., methyl, isobutyl, t-butyl, vinyl, benzyl, octadecyl, cyclohexyl, etc.), an aromatic group (e.g., phenyl, pyridyl, naphthyl, etc.), a heterocyclic group (e.g., piperidinyl, pyranyl, furanyl, chromanyl, etc .), an acyl group (e.g., acetyl, benzoyl, etc.) or a sulfonyl group (e.g., methanesulfonyl benzenesulfonyl, etc.).

$L_1$, $L_2$ and $L_3$ each represents

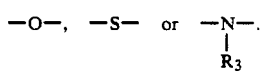

$L_3$ may further represent a single bond. Particularly, A is preferably a divalent group of the formula

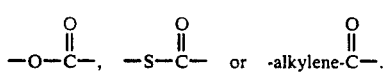

Among compounds of formula (I), the preferred is a compound which can be represented by formula (I-a), (I-b), (I-c) or (I-d) and whose second-order reaction rate constant $K_2$ (80° C.) with respect to p-anisidine is within the range of $1\times10^{-1}$ liter/mol.sec. to $1\times10^{-5}$ liter/mol.sec.

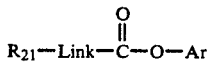

(I-a)

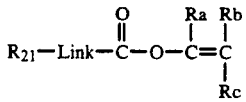

(I-b)

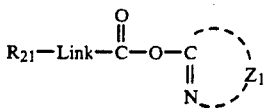

(I-c)

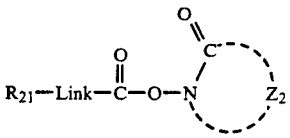

(I-d)

In the above formulas, $R_{21}$ has the same meaning as $R_{21}$ in formula (I). Link represents a single bond or —O—. Ar represents an aromatic group in the same category as defined for $R_{21}$, $R_{22}$ or B above. However, it is preferable that the leaving group liberated on reaction with an aromatic amine developing agent is not a group such as a hydroquinone derivative, a catechol derivative or the like that are useful as a photographic reducing agent.

Ra, Rb and Rc may be the same or different and each represents a hydrogen atom or an aliphatic, aromatic or heterocyclic group in the category defined for $R_{21}$, $R_{22}$ and B. Ra, Rb and Rc further represent alkoxy, aryloxy, heterocyclic oxy, alkylthio, arylthio, heterocyclic thio, amino, alkylamino, acyl, amido, sulfonamido, sulfonyl, alkoxycarbonyl, sulfo, carboxy, hydroxy, acyloxy, ureido, urethane, carbamoyl and sulfamoyl. Furthermore, Ra and Rb, or Rb and Rc, may be combined to form a 5- to 7-membered heterocyclic group which, in turn, may be further substituted or form a spiro ring, a bicyclo ring or a fused ring which is condensed with an aromatic ring. $Z_1$ and $Z_2$ each represents a nonmetal atomic group necessary to form a 5- to 7-membered heterocyclic group which, in turn, may be further substituted or form a spiro ring, a bicyclo ring or a fused ring which is condensed with an aromatic ring.

Referring particularly to formula (I-a), when Ar is a carbocyclic aromatic group, the second-order reaction rate constant $K_2$ (80° C.) with respect to p-anisidine can be controlled within the range of $1\times10^{-1}$ liter/mol.sec to $1\times10^{-5}$ liter/mol.sec by way of substituent groups. In this connection, depending upon the kind of group $R_{21}$, the total sum of Hammett o values of the respective substituents is preferably not less than 0.2, more preferably not less than 0 4, even more preferably, not less than 0.6.

When any of compounds of formulas (I-a) to (I-d) is added in the course of producing a photosensitive material, the total number of carbon atoms in each compound is preferably not less than 13. For accomplishing the objects of the present invention, compounds which are liable to decompose in development processing are undesirable.

Referring to formula (II), $Y_1$ is preferably an oxygen atom, a sulfur atom

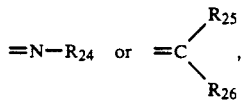

wherein $R_{24}$, $R_{25}$ and $R_{26}$ each represents a hydrogen atom, an aliphatic group (e.g., methyl, isopropyl, t-butyl, vinyl, benzyl, octadecyl, cyclohexyl, etc.), an aromatic group (e.g., phenyl, pyridyl, naphthyl, etc.), a heterocyclic group (e.g., piperidyl, pyranyl, furanyl, chromanyl, etc.), an acyl group (e.g., acetyl, benzoyl, etc.), or a sulfonyl group (e.g., methanesulfonyl, benzensulfonyl, etc.), and $R_{25}$ and $R_{26}$ may be combined to form a cyclic structure.

Among compounds of formulas (I) and (II), compounds of formula (I) are preferred. Of these compounds, compounds of formula (I-a) or (I-c) are more preferable and those of formula (I-a) are the most preferable.

Referring to formula (III), Z represents a nucleophilic group or a group which is decomposed in the photosensitive material to release a nucleophilic group. For example, there are known nucleophilic groups in which the atom to be chemically bound directly to an oxidized product of an aromatic amine developing agent is an oxygen, sulfur or nitrogen atom (e.g., amines, azides, hydrazine compounds, mercapto compounds, sulfides, sulfinic acid compounds, cyano compounds, thiocyano compounds, thiosulfate compounds, seleno compounds, halides, carboxy compounds, hydroxamic acid compounds, active methylene compounds, phenol compounds, nitrogen-containing heterocyclic compounds, etc.).

Among compounds of formula (III), compounds of formula (III-a) below are preferred.

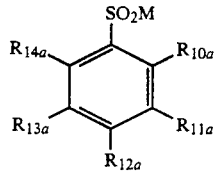

(III-a)

wherein M represents an atom or atomic group which forms an inorganic (e.g., Li, Na, K, Ca, Mg, etc.) or organic (e.g., triethylamine, methylamine, ammonia, etc.) salt,

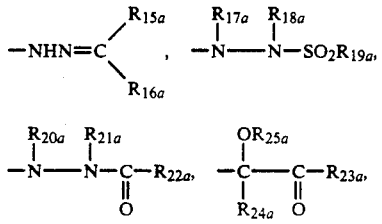

or a hydrogen atom.

In the above formulas, $R_{15a}$ and $R_{16a}$ may be the same or different and each represents a hydrogen atom, an aliphatic group, an aromatic group or a heterocyclic group. $R_{15a}$ and $R_{16a}$ may link to form a 5- to 7-membered ring. $R_{17a}$, $R_{18a}$, $R_{20a}$ and $R_{21a}$ may be the same or different and each represents hydrogen, an aliphatic group, an aromatic group, a heterocyclic group, an acyl group, an alkoxycarbonyl group, a sulfonyl group, a ureido group or a urethane group. However, at least one of $R_{17a}$ and $R_{18a}$ and at least one of $R_{20a}$ and $R_{21a}$ are a hydrogen atom. $R_{19a}$ and $R_{22a}$ each represents hydrogen, an aliphatic group, an aromatic group or a heterocyclic group. $R_{19a}$ further represents an alkylamino group, an arylamino group, an alkoxy group, an aryloxy group, an acyl group, an alkoxycarbonyl group or an aryloxycarbonyl group. Of $R_{17a}$, $R_{18a}$ and $R_{19a}$, at least two may link to form a 5- to 7-membered ring. Similarly, at least two of $R_{20a}$, $R_{21a}$ and $R_{22a}$ may link to form a 5- to 7-membered ring. $R_{23a}$ represents hydrogen, an aliphatic group, an aromatic group or a heterocyclic group and $R_{24a}$ represents hydrogen, an aliphatic group, an aromatic group, a halogen, an acyloxy group or a sulfonyl group. $R_{25a}$ represents hydrogen or a hydrolyzable group.

$R_{10a}$, $R_{11a}$, $R_{12a}$, $R_{13a}$ and $R_{14a}$ may be the same or different and each represents a hydrogen atom, an aliphatic group (e.g., methyl, isopropyl, t-butyl, vinyl, benzyl, octadecyl, cyclohexyl, etc.), an aromatic group (e.g., phenyl, pyridyl, naphthyl, etc.), a heterocyclic group (e.g., piperidyl, pyranyl, furanyl, chromanyl, etc.), a halogen tom (e.g., chlorine, bromine, etc.), $$-SR_{26a},\quad OR_{26a},\quad -\underset{\underset{R_{27a}}{|}}{N}-R_{26a},$$

an acyl group (e.g., acetyl, benzoyl, etc.), an alkoxycarbonyl group (e.g., methoxycarbonyl, butoxycarbonyl, cyclohexylcarbonyl, octyloxycarbonyl, etc.), an aryloxycarbonyl group (e.g., phenyloxycarbonyl, naphthyloxycarbony, etc.), a sulfonyl group (e.g., methanesulfonyl, benzenesulfonyl, etc.), a sulfonamide group (e.g., methanesulfonamido, benzenesulfonamido, etc.), a sulfamoyl group, a ureido group, a urethane group, a carbamoyl group, a sulfo group, a carboxy group, a nitro group, a cyano group, an alkoxalyl group (e.g., methoxalyl, isobutoxalyl, octyloxalyl, benzoyloxalyl, etc.), an aryloxalyl group (e.g., phenoxalyl, naphthoxalyl, etc.), a sulfonyloxy group (e.g., methanesulfonyloxy, benzensulfonyloxy, etc.), $$-P\begin{matrix}R_{28a}\\R_{29a}\end{matrix},\quad -\overset{O}{\overset{\|}{P}}\begin{matrix}R_{28a}\\R_{29a}\end{matrix},\quad -\overset{S}{\overset{\|}{P}}\begin{matrix}R_{28a}\\R_{29a}\end{matrix}$$

or a formyl group. In these formulas, $R_{26a}$ and $R_{27a}$ may be the same or different and each represents hydrogen, an aliphatic group, an aromatic group, an acyl group or a sulfonyl group. $R_{28a}$ and $R_{29a}$ may be the same or different and each represents hydrogen, an aliphatic group, an aromatic group, an alkoxy group or an aryloxy group.

Preferred in terms of the effect of the present invention are $R_{10a}$, $R_{11a}$, $R_{12a}$, $R_{13a}$ and $R_{14a}$ having the total sum of Hammett $\sigma$ values of these substituents on the benzene ring with respect to the $-SO_2M$ group of not less than 0.5.

Examples of compounds of formulas (I) to (III) are shown below. These examples are merely illustrative and are not to be understood as limiting the invention in any way.

(Ia-1)

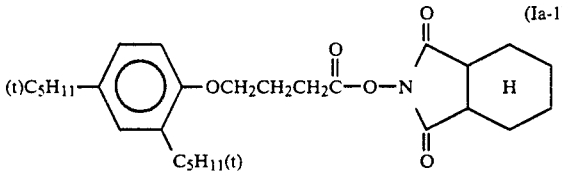

(Ia-2)

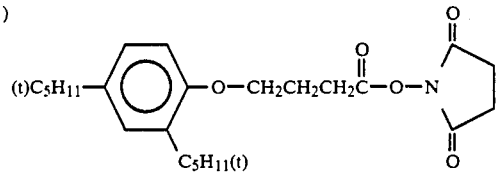

(Ia-3)

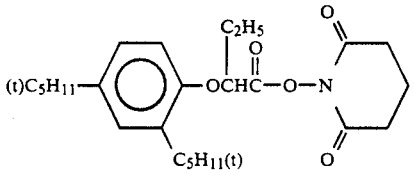

(Ia-4)

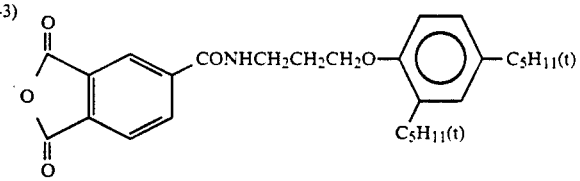

(Ia-5)

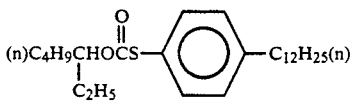

(Ia-6)

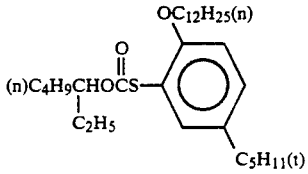

(Ia-7) $(n)C_{18}H_{37}I$ (Ia-8) $(n)C_{18}H_{37}Br$ (Ia-9)

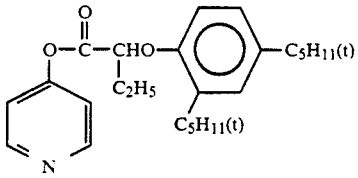

(Ia-10)

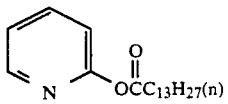

-continued
(Ia-11)
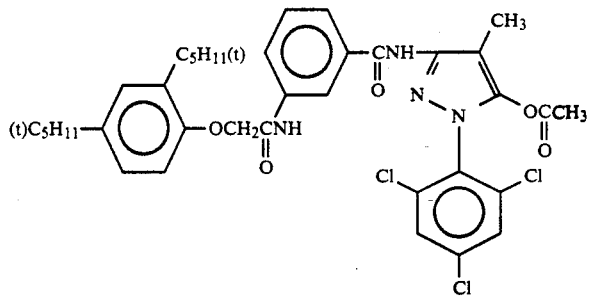
(Ia-12)
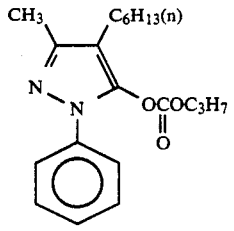
(Ia-13)
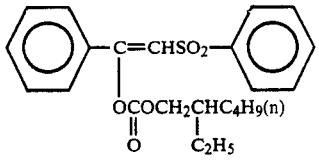
(Ia-14)
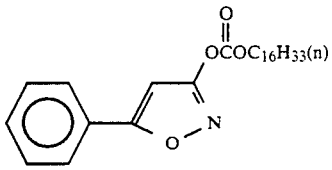
(Ia-15)
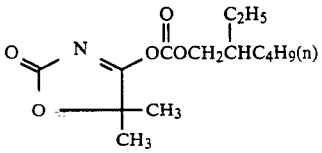
(Ia-16)
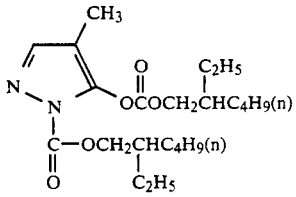
(Ia-17)
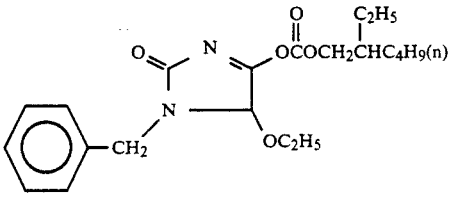
(Ia-18)
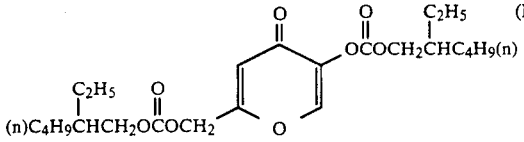
(Ia-19)
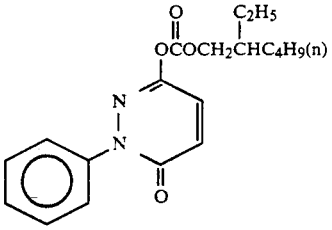
(Ia-20)
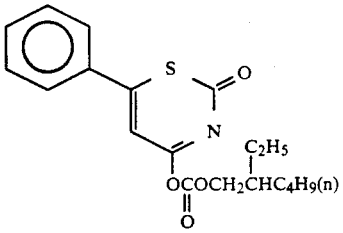
(Ia-21)
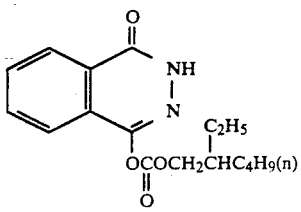
(Ia-22)
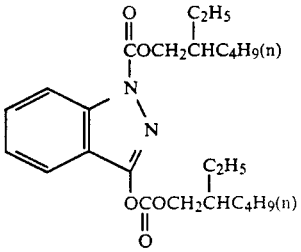
(Ia-23)
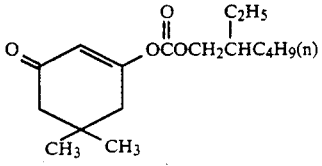

-continued
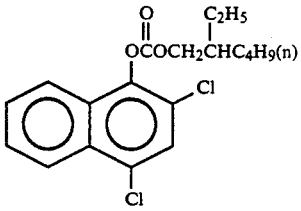
(Ia-24)
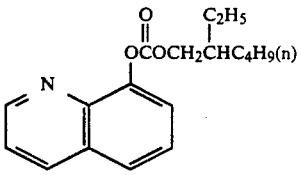
(Ia-25)
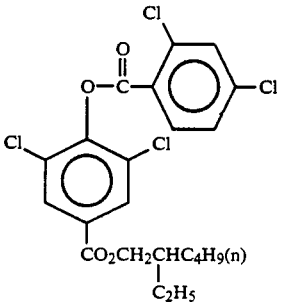
(Ia-26)
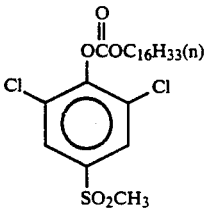
(Ia-27)
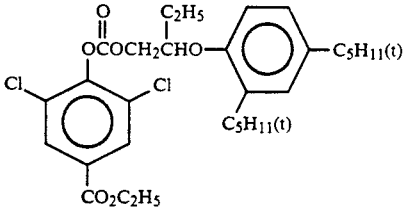
(Ia-28)
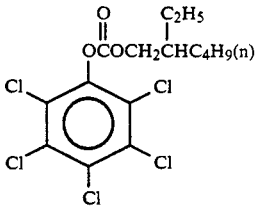
(Ia-29)
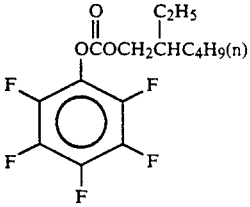
(Ia-30)
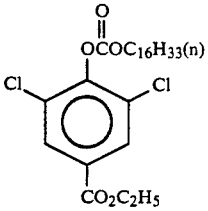
(Ia-31)
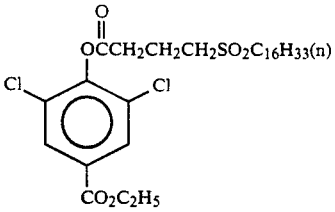
(Ia-32)
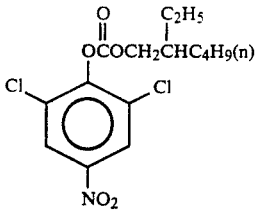
(Ia-33)
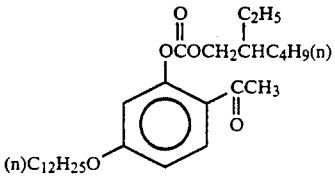
(Ia-34)
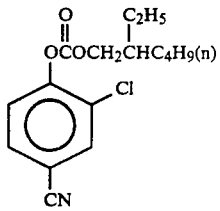
(Ia-35)
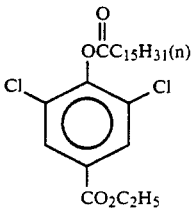
(Ia-36)

-continued
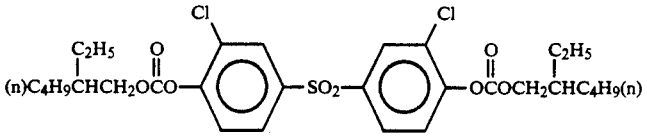
(Ia-37)
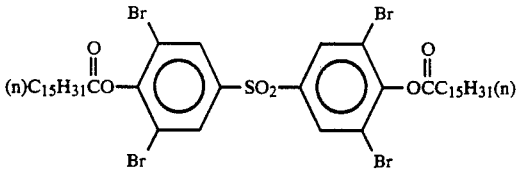
(Ia-38)
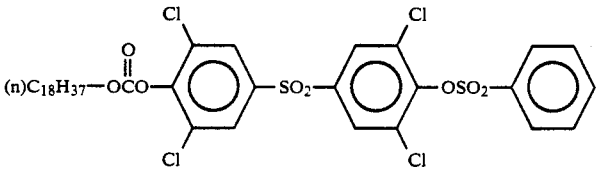
(Ia-39)
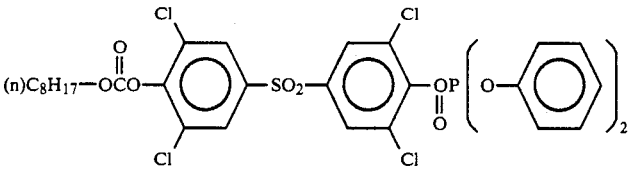
(Ia-40)
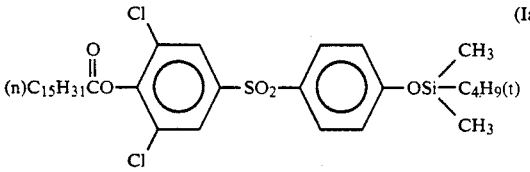
(Ia-41)
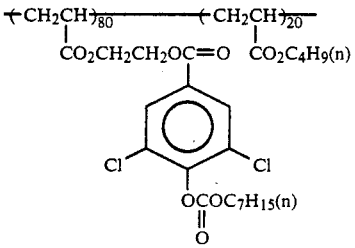
(Ia-42)
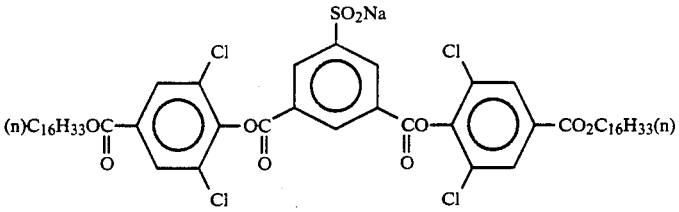
(Ia-43)
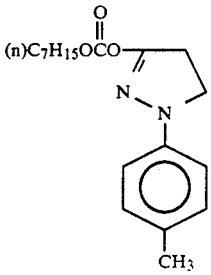
(Ia-44)
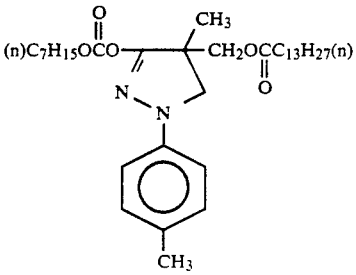
(Ia-45)

-continued
(Ia-46)
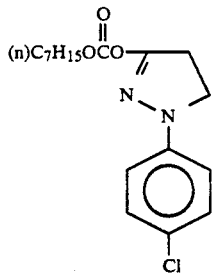
(Ia-47)
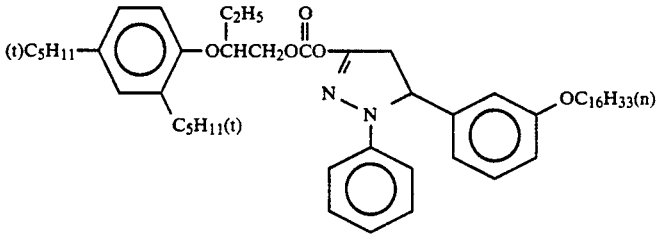
(Ia-48)
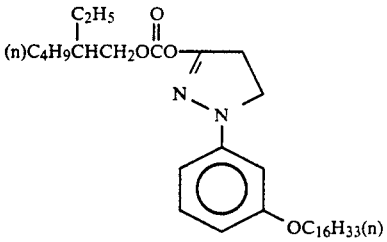
(Ia-49)
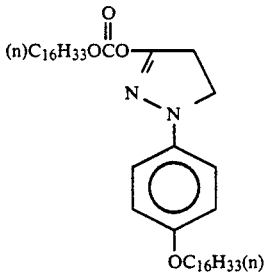
(Ia-50)
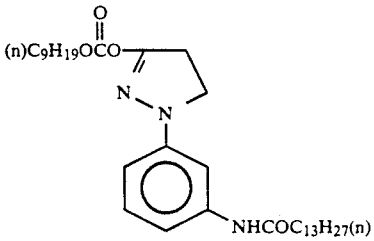
(Ia-51)
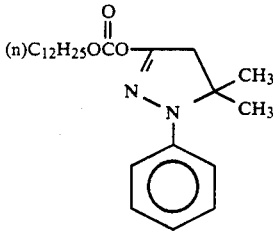
(IIa-1)
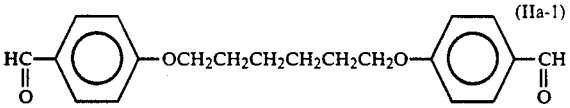
(IIa-2)
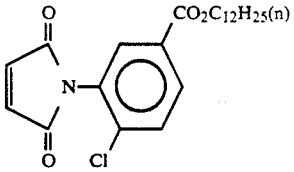
$CH_2{=}CH{-}SO_2{-}C_{18}H_{37}(n)$ (IIa-3)
(IIa-4)
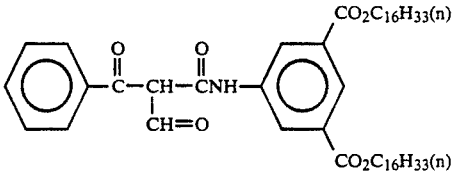
(IIa-5)
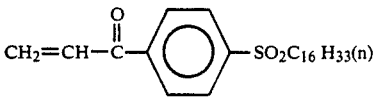

-continued
(IIIa-1)
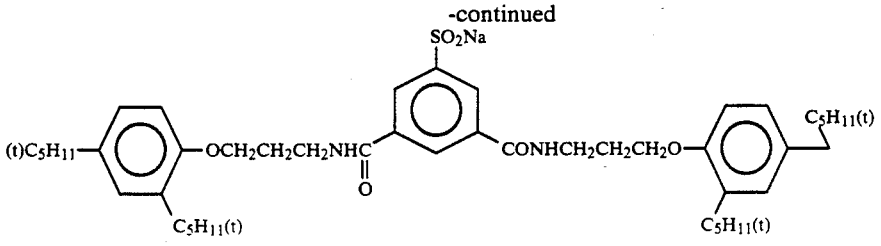
(IIIa-2)
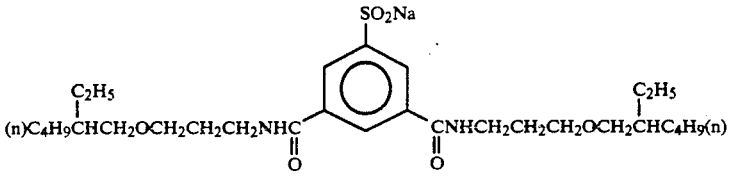
(IIIa-3)
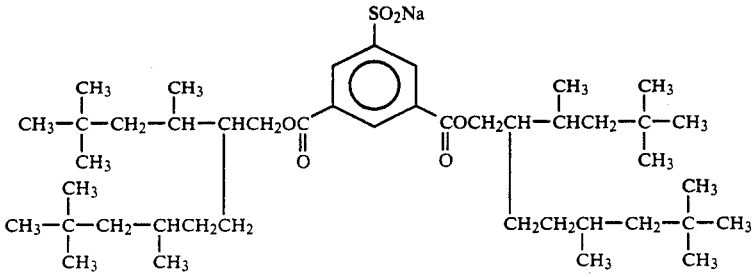
(IIIa-4)
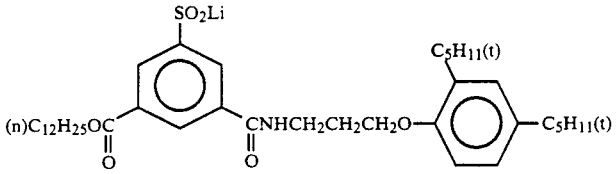
(IIIa-5)
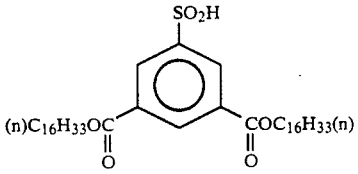
(IIIa-6)
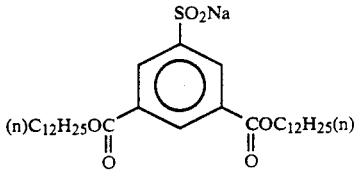
(IIIa-7)
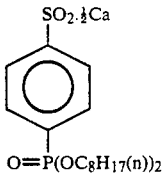
(IIIa-8)
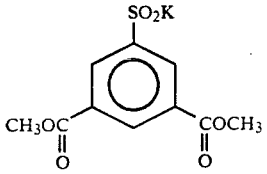
(IIIa-9)
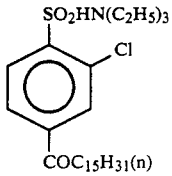
(IIIa-10)
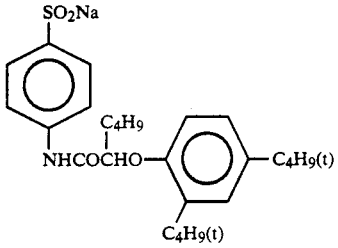
(IIIa-11)
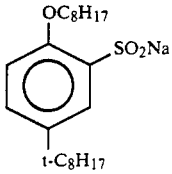
(IIIa-12)
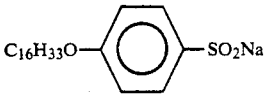

-continued
(IIIa-13)
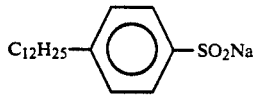
(IIIa-14)
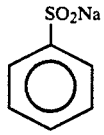
(IIIa-15)
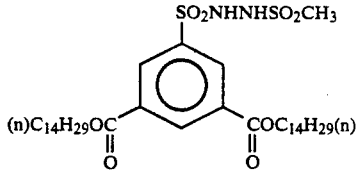
(IIIa-16)
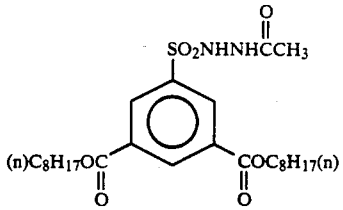
(IIIa-17)
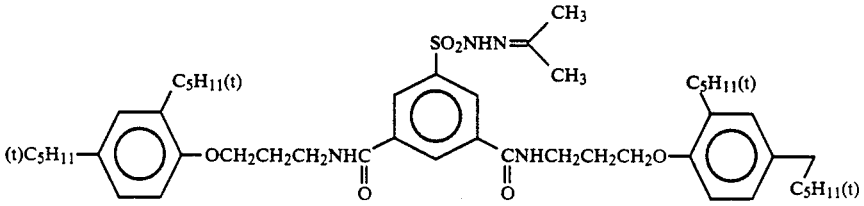
(IIIa-18)
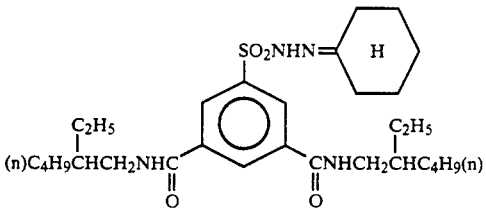
(IIIa-19)
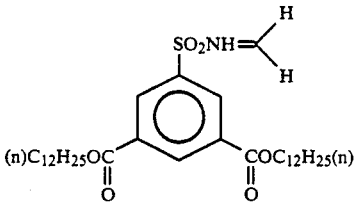
(IIIa-20)
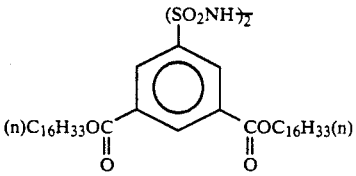
(IIIa-21)
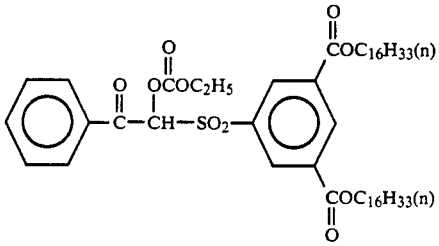
(IIIa-22)
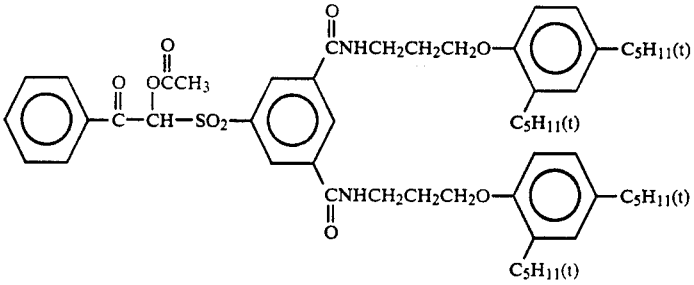
(IIIa-23)
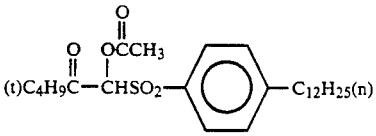
(IIIa-24)
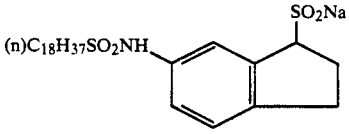
(IIIa-25)
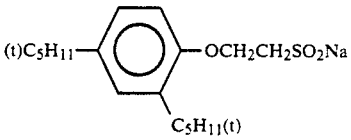
(IIIa-26)
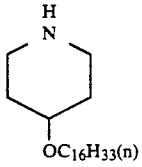

-continued (IIIa-27)

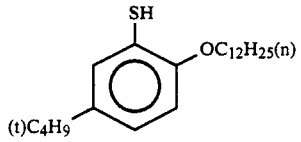

(IIIa-28)

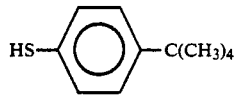

(IIIa-29)

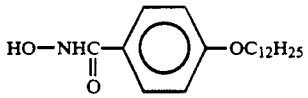

(IIIa-30)

$NaN_3$ (IIIa-31)

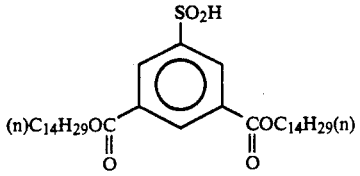

(IIIa-32)

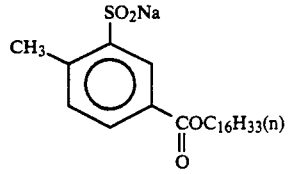

(IIIa-33)

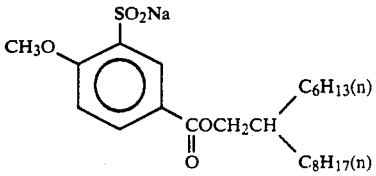

(IIIa-34)

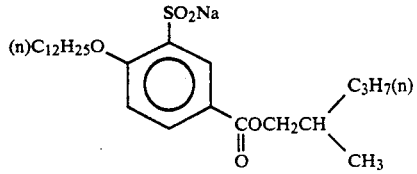

(IIIa-35)

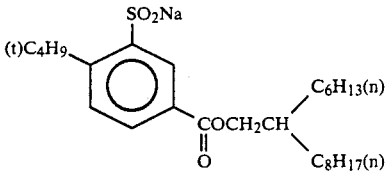

(IIIa-36)

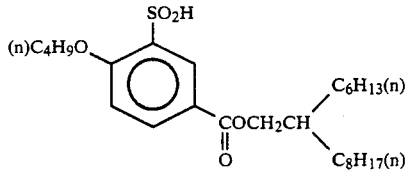

(IIIa-37)

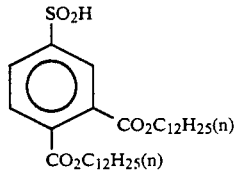

(IIIa-38)

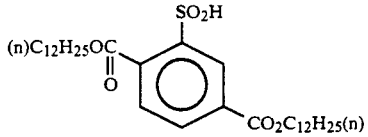

(IIIa-39)

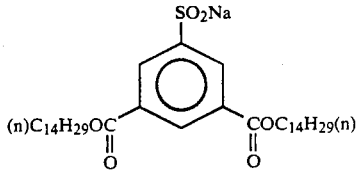

(IIIa-40)

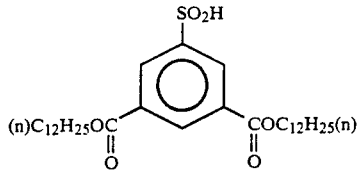

(IIIa-41)

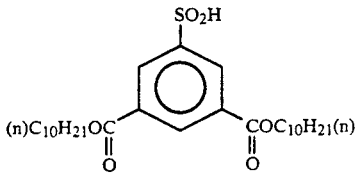

(IIIa-42)

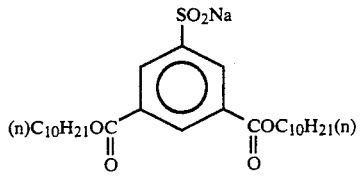

The above compounds can be synthesized by the processes described in JP-A-62-143048, JP-A-63-115855, JP-A-63-115866 and JP-A-63-158545 and Laid-open European Patent No. 255722 or processes analogous thereto.

The preferred compounds for the purposes of the present invention include the compounds specifically disclosed in the patent literature cited above or in the specifications of JP-A-62-283338 and JP-A-62-229145.

Compounds of formulas (I) and (II) form a colorless compound, and react with and form a chemical bond with an aromatic amine developing agent, and compounds of formula (III) form a colorless compound, and react with and form a chemical bond oxidized product of an amine developing agent.

Of the compounds of formulas (I), (II), (III), compounds of low molecular weight or those readily soluble in water may be added to a processing solution so that they may be taken up into the photosensitive material during development. However, these compounds are preferably incorporated into the hydrophilic colloid layer of the photosensitive material in the fabrication stage.

The preferred compounds of formulas (I), (II) and (III) are those soluble in high-boiling organic solvents. They are added in an amount of from $1\times10^{-2}$ to 10 mols, preferably $3\times10^{-2}$ to 5 mols, per mole of the coupler. These compounds are preferably coemulsified with a magenta coupler.

The color photographic material of the present invention can be fabricated by providing at least one each of a blue-sensitive silver halide emulsion layer, a green-sensitive silver halide emulsion layer and a red-sensitive emulsion layer on a support. In the manufacture of an ordinary color printing paper, these layers are usually coated in the above order. In the present invention, however, the layers may be coated in a different order. Moreover, an infrared-sensitive silver halide emulsion layer may be used in lieu of at least one of the above mentioned emulsion layers. For subtractive color reproduction, spectrally sensitive silver halide emulsions and color couplers which form the corresponding complementary color dyes (i.e., yellow for blue, magenta for green, and cyan for red) are used in the above mentioned photosensitive emulsion layers. However, there need not be such correspondence between the photosensitive layer and the hue of the coupler.

The silver halide emulsion to be used in the practice of the present invention is preferably an emulsion substantially free from silver iodide and consisting essentially of silver chloride or silver chlorobromide with an AgCl content of not less than 90 mol. %. Preferably, the silver chloride content is not less than 95 mol. %. The term "substantially free from silver iodide" means that the silver iodide content of the emulsion is not greater than 1 mol. %, preferably 0.2 mol. %. While the halogen composition may vary from one grain to another or be uniform, the use of an emulsion having a uniform halogen composition makes it easy to homogenize the characteristics of the respective grains. With regard to the halogen distribution within the silver halide emulsion grain, homogenous grains, each of which are thoroughly uniform in halogen composition, laminar grains which vary in halogen composition between the core and the surrounding shell or shells, and grains having one or more locally heterogeneous regions in non-laminar fashion in the core of the grain or on the surface (when such a heterogeneous region exists on the grain surface, the boundary between different phases may be present at the edge, corner or plane of the grain) can be employed, for example. To insure high sensitivity, grains of the latter two structures are preferred to homogenous grains. This is also preferred in terms of pressure resistance. When the silver halide grains have the above mentioned structures, the boundary between two different phases may be discrete or unclear as the result of formation of mixed crystals. Furthermore, grains deliberately given a continuous change in structure can also be employed.

In such a silver chloride-rich emulsion, the local silver bromide phase is preferably present in the core and/or on the surface of the grain in the above mentioned laminar or non-laminar pattern. The halogen composition of such a localized phase preferably contains at least 10 mol. % and more preferably, more than 20 mol. % of silver bromide. While such a localized phase may exist in the core of the grain or at the edge, corner and/or plane of the grain surface, one preferred example is an epitaxially grown AgBr phase at a corner of the grain.

On the other hand, for the purpose of minimizing the decrease in sensitivity by a pressure applied to the photosensitive material, it is preferable to use homogenous grains with a small variation in intra-grain halogen composition within the grain even in the case of a high chloride (not less than 90 mol. %) silver halide emulsion.

Furthermore, for the purpose of reducing the replenishing rate of the development processing bath, it is useful to further increase the silver chloride content of the silver halide emulsion. In such cases, a substantially pure silver chloride emulsion with an AgCl content of 98 to 100 mol. % can be advantageously employed.

The average grain size (the diameter of a circle equivalent to the projected area of a grain is taken as grain size and the number average of such diameters is used) of the silver halide emulsion to be employed in the present invention is preferably 0.1 μm to 2 μm.

The grain size distribution is preferably monodisperse, that is to say, the coefficient of variation (the standard deviation of grain size distribution divided by the mean grain size) is not greater than 20% and preferably not greater than 15%. To broaden the latitude, it may be preferable to use such monodisperse emulsions as a blend in the same layer or in superimposed layers.

The morphology of silver halide grains in the photographic emulsion may be regular, for example, cubic, tetradecahedral or octahedral, or irregular, for example, spherical or tabular, or even a combination of them. A mixture of various crystal forms may also be employed. In the present invention, it is preferable to employ an emulsion containing not less than 50%, preferably not less than 70% and more preferably not less than 90% of said regular grains.

Aside from the foregoing, an emulsion containing more than 50%, relative to the total projected area of all grains, of tabular grains with an average aspect ratio (diameter of equivalent circle/thickness) of not less than 5 and preferably not less than 8 can be advantageously employed.

The silver chlorobromide emulsion to be employed in the present invention can be prepared by the methods described in P. Glafkides, *Chimie et Physique Photographique* (Paul Montel, 1967), G. F. Duffin, *Photographic Emulsion Chemistry* (Focal Press, 1966), V. L. Zelikman et al, *Making and Coating Photographic Emulsion* (Focal press, 1964) and other literature. Thus, any of the acid, neutral and ammonia processes can be employed. In the process in which a soluble silver salt is reacted with a soluble halide, the single jet or/and double jet method can be employed. A method (reverse mixing method) in which grains are formed in an atmosphere of excess silver ion can also be employed. One version of the double jet method is controlled double jet method in which pAg in the liquid phase giving rise to silver halide is kept constant. Using this method, a silver halide emulsion of regular crystal morphology and nearly uniform grain size can be obtained.

In the silver halide emulsion to be used in the present invention, a variety of polyvalent metal ion impurities can be incorporated in the course of emulsion grain formation or in the physical ripening stage. The compounds used for this purpose include, for example, salts of cadmium, zinc, lead, copper, thallium, etc., and salts or complex salts of group VIII elements such as iron, ruthenium, rhodium, palladium, osmium, iridium, platinum, etc. The group VIII elements mentioned above are particularly useful. The level of addition of such compounds may vary widely but is preferably within the range of $10^{-3}$ to $10^{-2}$ mol relative to silver halide.

The silver halide emulsion to be used in the present invention is generally subjected to chemical sensitization and spectral sensitization.

With regard to chemical sensitization, sulfur sensitization which is typically achieved by addition of a labile sulfur compound, noble metal sensitization which is typically gold sensitization, reductive sensitization, etc., can be used independently or in combination. As to the specific compounds used for chemical sensitization, the compounds mentioned on page 18, bottom right col., to page 22, top right col., of the specification of JP-A-62-215272 can be advantageously employed.

Spectral sensitization is intended to provide the emulsions in the respective layers of the photosensitive material of the present invention with spectral sensitivities to the desired wavelengths of light. In the present invention, this is preferably done by adding dyes which absorb in the wavelength regions corresponding to the desired spectral sensitivities, that is to say, spectral sensitizing dyes. Spectral sensitizing dyes that can be used for this purpose include the dyes mentioned in F. M. Harmer, Heterocyclic Compounds—Cyanine Dyes and Related Compounds (John Wiley & Sons, New York, London, 1964). As to specific examples of such compounds and the method for spectral sensitization, those described on page 22, top right col. to page 38 of the specification of the above mentioned JP-A-62-215272 can be used advantageously.

In the silver halide emulsion to be used in the present invention, a variety of compounds or precursors thereof can be incorporated for preventing fogging during the manufacture and storage of the photosensitive material or in the course of processing or for stabilizing the photographic characteristics. Preferred specific examples of such compounds are described on pages 39 to 72 of the specification of JP-A-62-215272 referred to above.

The emulsion to be used in the present invention may be either a surface latent image emulsion in which the latent image is mainly formed on the grain surface or an internal latent image emulsion in which the latent image is mainly formed in the core region of the grain.

When the present invention is applied to a color photosensitive material, a yellow coupler, a magenta coupler and a cyan coupler which couple with the oxidized form of an aromatic amine developing agent to produce yellow, magenta and cyan colors are generally incorporated in the color photosensitive material.

The cyan, magenta and yellow couplers which can be advantageously employed in the present invention can be represented by the following formulas (C-I), (C-II), (M-I), (M-II) and (Y).

(C-I)

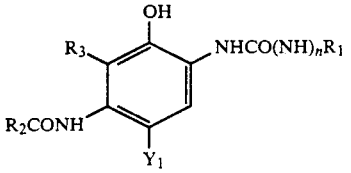

-continued (C-II)

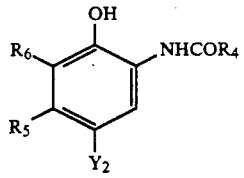

(M-I)

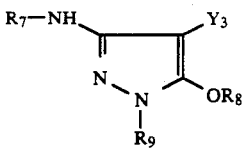

(M-II)

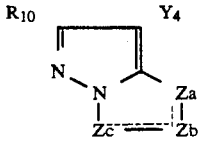

(Y)

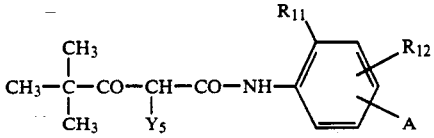

Referring to formulas (C-I) and (C-II), $R_1$, $R_2$ and $R_4$ each represents a substituted or unsubstituted aliphatic, aromatic or heterocyclic group. $R_3$, $R_5$ and $R_6$ each represents hydrogen, a halogen, an aliphatic group, an aromatic group or an acylamino group. $R_3$ and $R_2$ may combine to form a nitrogen-containing 5- or 6-membered nonmetal atomic group. $Y_1$ and $Y_2$ each represents hydrogen or a group which leaves on a coupling reaction with an oxidized developing agent. Furthermore, n is equal to 0 or 1.

$R_5$ in formula (C-II) is preferably an aliphatic group such as methyl, ethyl, propyl, butyl, pentadecyl, tert-butyl, cyclohexyl, cyclohexylmethyl, phenylthiomethyl, dodecyloxyphenylthiomethyl, butanamidomethyl, and methoxymethyl.

The cyan coupler represented by formula (C-I) or (C-II) includes the following preferred examples.

Thus, in formula (C-I), $R_1$ is preferably an aryl group or a heterocyclic group and, for still better results, an aryl group substituted by halogen, alkyl, alkoxy, aryloxy, acyloxy, acyl, carbamoyl, sulfonamido, sulfamoyl, sulfonyl, sulfamido, oxycarbonyl and/or cyano.

Referring to formula (C-I), wherein $R_3$ and $R_2$ do not combine to form a ring, $R_2$ is preferably a substituted or unsubstituted alkyl or aryl group and, for still better results, a substituted aryloxy-substituted alkyl group, while $R_3$ is preferably hydrogen.

Referring to formula (C-II), $R_4$ is preferably a substituted or unsubstituted alkyl or aryl group and more preferably a substituted aryloxy-substituted alkyl group.

Referring to formula (C-II), $R_5$ is preferably a $C_{2-15}$ alkyl group or a methyl group having a substituent group of one or more carbon atoms and the substituent group may be an arylthio group, an alkylthio group, an acylamino group, an aryloxy group or an alkyloxy group.

In formula (C-II), $R_5$ is more preferably an alkyl group of 2 to 15 carbon atoms and, for still better results, an alkyl group of 2 to 4 carbon atoms.

Referring, further, to formula (C-II), $R_6$ is preferably hydrogen or a halogen and preferably a chlorine atom or a fluorine atom. In formulas (C-I) and (C-II), $Y_1$ and $Y_2$ each is preferably hydrogen, a halogen, an alkoxy group, an aryloxy group, an acyloxy group or a sulfonamido group.

Referring to formula (M-I), $R_7$ and $R_9$ each represents an aryl group; $R_8$ represents hydrogen, an aliphatic or aromatic acyl group, or an aliphatic or aromatic sulfonyl group; and $Y_3$ represents hydrogen or a leaving group. The aryl groups $R_7$ and $R_9$ can be substituted. The substituent groups which can be present on the aryl groups (preferably phenyls) $R_7$ and $R_9$ are the same as those which can be present as substituents for the substituent $R_1$, and when two or more substituent groups are present, they may be the same or different. $R_8$ is preferably hydrogen, an aliphatic acyl group or a sulfonyl group and, for still better results, hydrogen. $Y_3$ is preferably a group which leaves at the sulfur, oxygen or nitrogen atom thereof, and the groups leaving at S as mentioned in U.S. Pat. No. 4,351,897 and Laid-open International Patent WO 88/04795, for instance, are particularly preferred.

Referring to formula (M-II), $R_{10}$ represents hydrogen or a substituent group. $Y_4$ represents hydrogen or a leaving group which is preferably a halogen or an arylthio group. Za, Zb and Zc each represents a substituted or unsubstituted methine group, =N— or —NH—, and one of the Za-Zb bond and Zb-Zc bond is a double bond, with the other being a single bond. When the Zb-Zc bond is a carbon-carbon double bond, it may optionally be part of an aromatic ring. A dimer or polymer may be formed through $R_{10}$ or $Y_4$, and a dimer or polymer may be formed through Za, Zb or Zc when it is a substituted methine group.

Referring to the pyrazoloazole coupler of formula (M-II), the imidazo[1,2-b]pyrazoles described in U.S. Pat. No. 4,500,630 are preferred in terms of the scarcity of yellow side absorptions and light fastness, and in this sense, pyrazolo[1,5-b][1,2,4]triazole, mentioned in U.S. Pat. No. 4,540,654, is particularly preferred.

Aside from the foregoing, the pyrazolotriazole couplers in which a branched alkyl group is directly attached to the 2-, 3- or 6-position of the pyrazolotriazole ring as described in JP-A-61-65245, the pyrazoloazole couplers containing a sulfonamido group within the molecule as described in JP-A-61-65246, the pyrazoloazole couplers having an alkoxyphenylsulfonaide ballast group as described in JP-A-61-147254, and the pyrazolotriazole couplers having an alkoxy or aryloxy group in 6-position as described in European Patents (Laid-Open) 226,849 and 294,785 are preferably employed.

Referring to formula (Y), $R_{11}$ represents a halogen, an alkoxy group, a trifluoromethyl group or an aryl group and $R_{12}$ represents hydrogen, a halogen or an alkoxy group. A represents $$-NHCOR_{13},\quad -NHSO_2-R_{13},\quad -SO_2NHR_{13},$$

$$-COOR_{13}\quad \text{or}\quad -SO_2\underset{\underset{R_{14}}{|}}{N}-R_{13},$$

wherein $R_{13}$ and $R_{14}$ each is an alkyl group, an aryl group or an acyl group. $Y_5$ represents a leaving group. $R_{12}$, $R_{13}$ and $R_{14}$ may contain a substituent group. The substituent groups which can be present on $R_{12}$, $R_{13}$ and $R_{14}$ are the same as those which can be present on the substituent $R_1$, and the leaving group Y5 is preferably a group which leaves at the oxygen atom or nitrogen atom thereof and more desirably an N-leaving group.

The following are illustrative examples of the couplers of formulas (C-I), (C-II), (M-I), (M-II) and (Y).

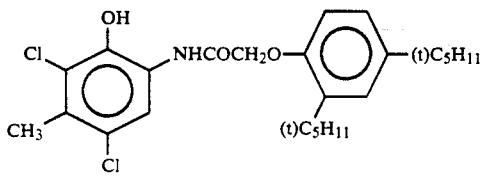

(C-1)

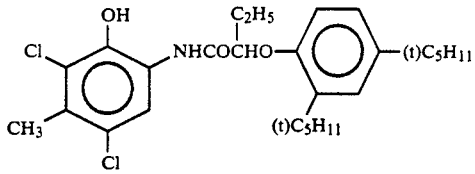

(C-2)

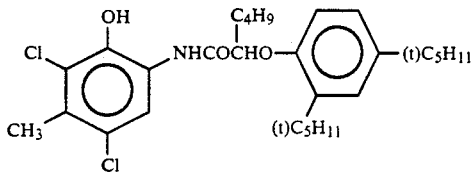

(C-3)

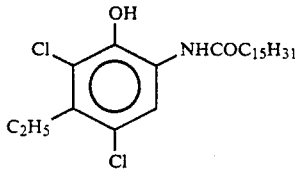

(C-4)

-continued
(C-5)
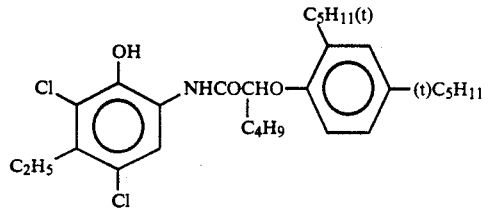
(C-6)
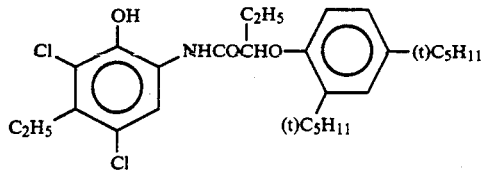
(C-7)
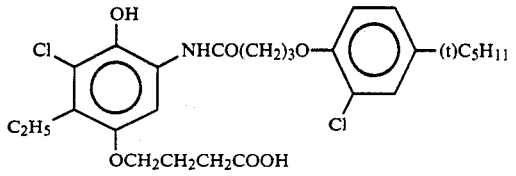
(C-8)
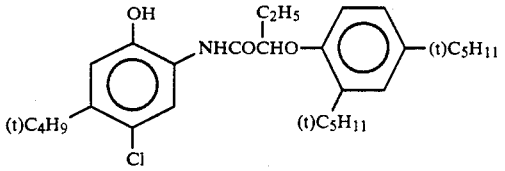
(C-9)
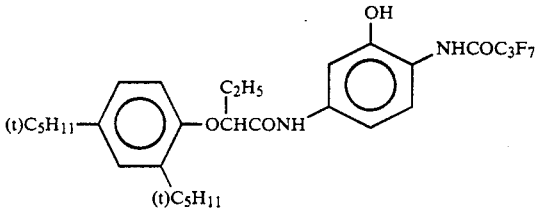
(C-10)
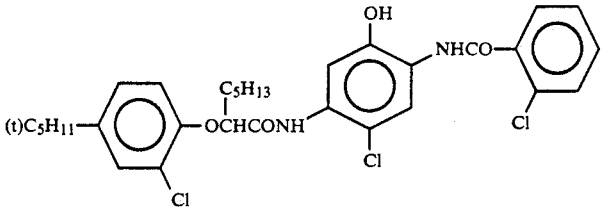
(C-11)
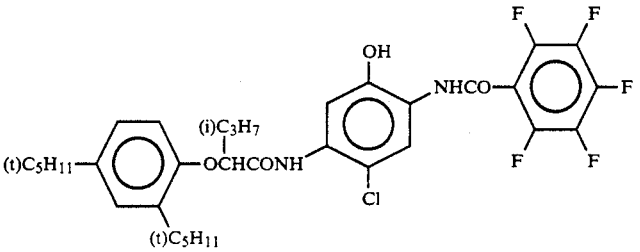

-continued
(C-12)
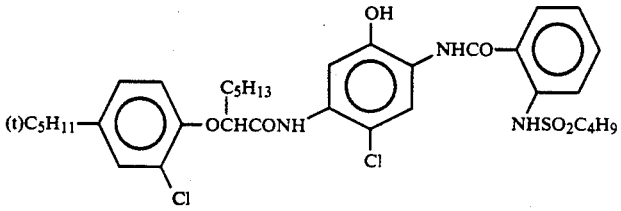
(C-13)
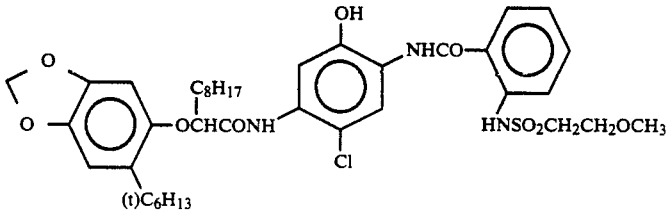
(C-14)
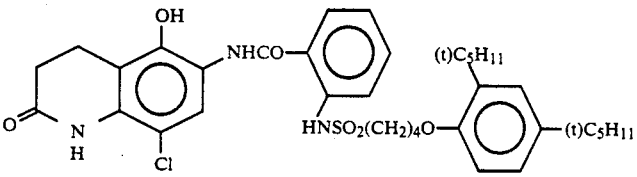
(C-15)
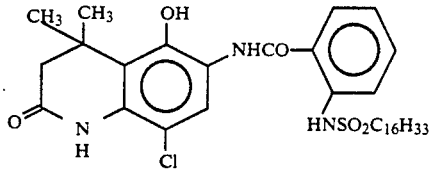
(C-16)
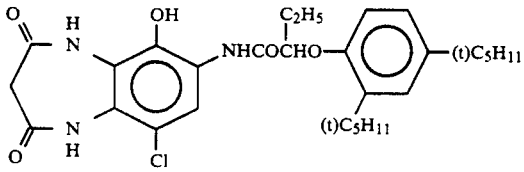
(C-17)
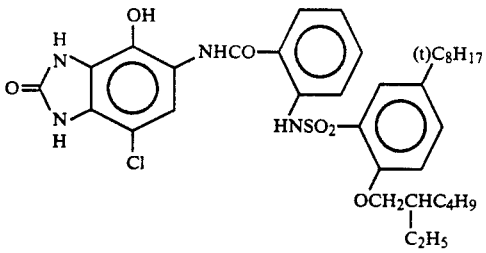
(C-18)
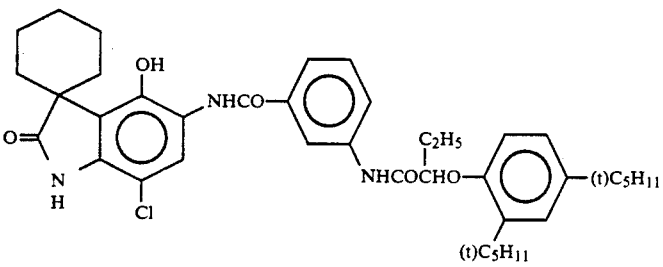

-continued
(C-19)
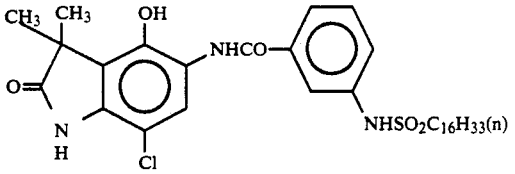
(C-20)
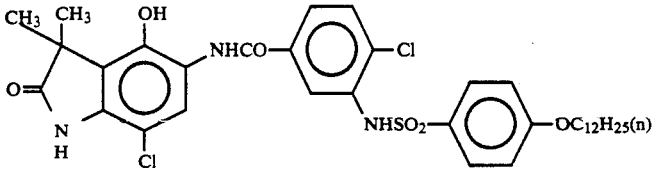
(C-21)
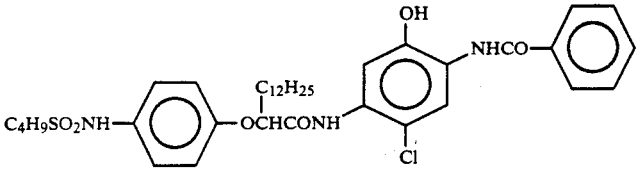
(C-22)
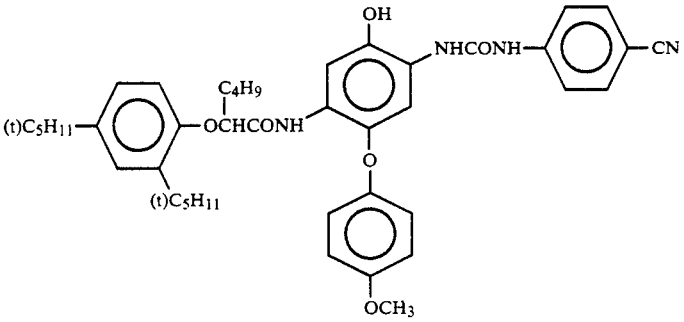
(M-1)
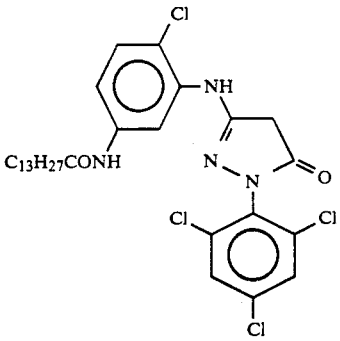
(M-2)
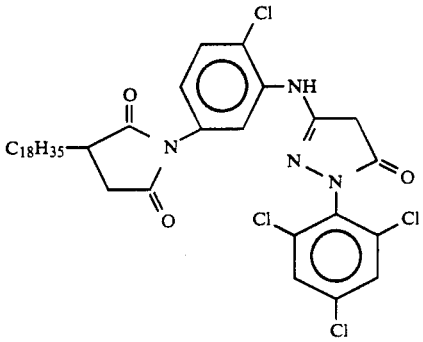

-continued
(M-3)
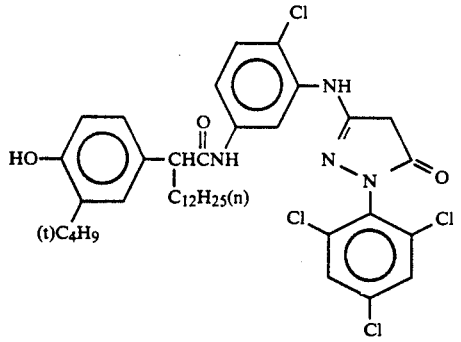
(M-4)
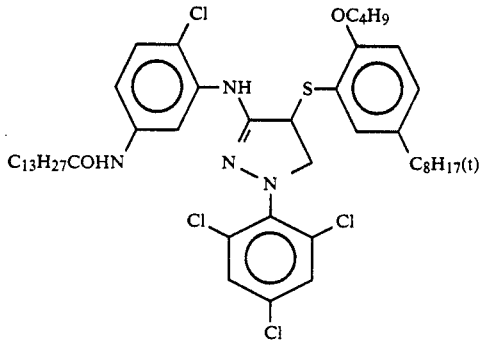
(M-5)
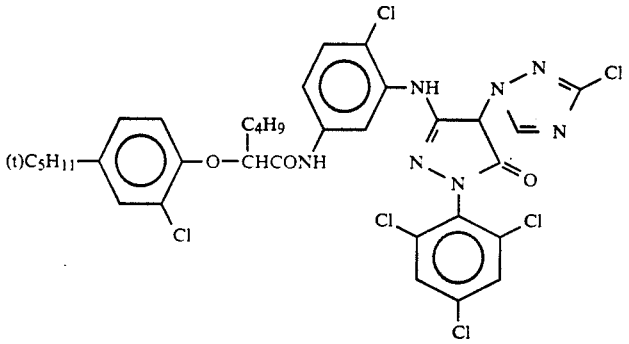
(M-6)
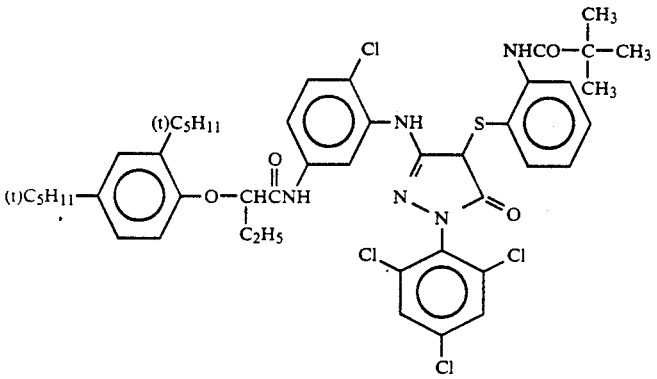

-continued
(M-7)
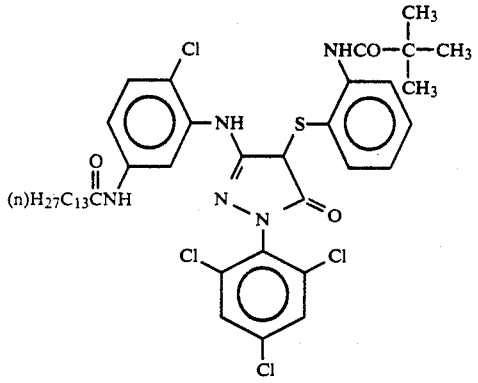
(M-8)
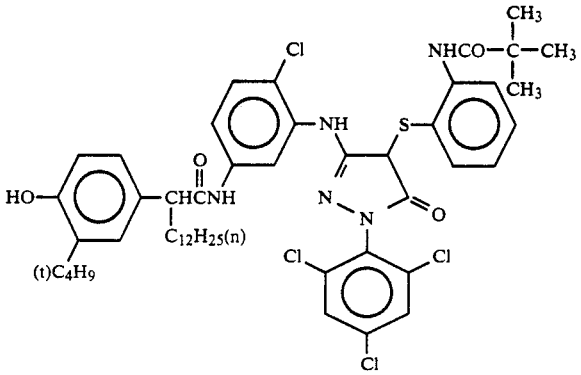
| Compound | $R_{10}$ | $R_{15}$ | $Y_4$ |
|---|---|---|---|
| | | 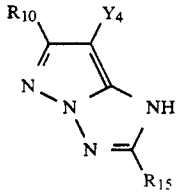 | |
| M-9 | $CH_3$— | 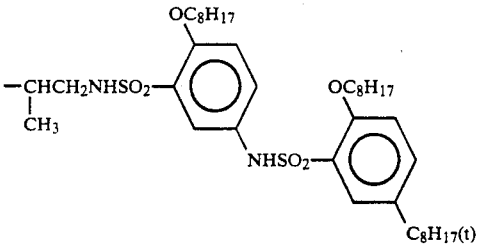 | Cl |
| M-10 | $CH_3$— | 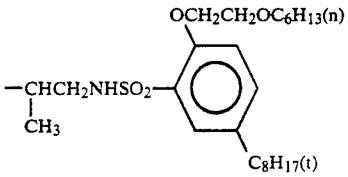 | Cl |
| M-11 | $(CH_3)_3C$— | 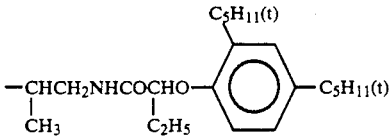 | 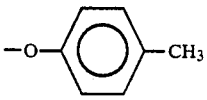 |

-continued
| | | | |
|---|---|---|---|
| M-12 | 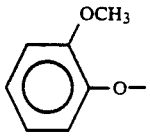 | 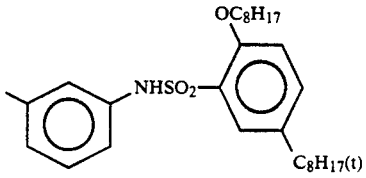 | 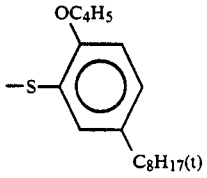 |
| M-13 | $CH_3$— | 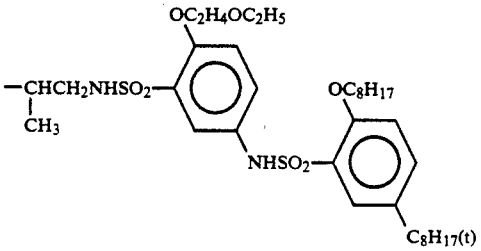 | Cl |
| M-14 | $CH_3$— | 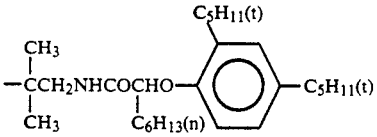 | Cl |
| M-15 | $CH_3$— | 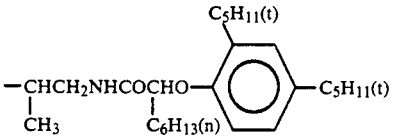 | Cl |
| M-16 | $CH_3$— | 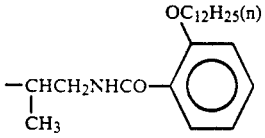 | Cl |
| M-17 | $CH_3$— | 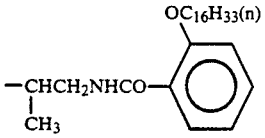 | Cl |
| M-18 | 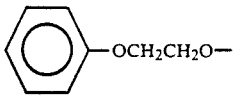 | 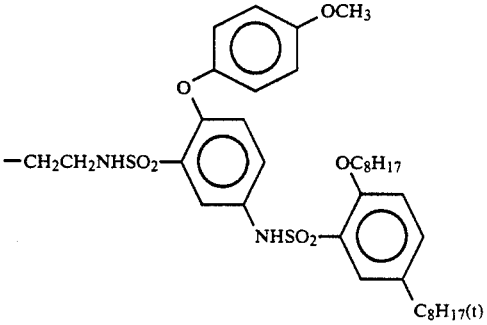 | 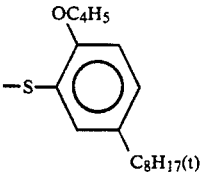 |

-continued
| | | | |
|---|---|---|---|
| M-19 | $CH_3CH_2O-$ | 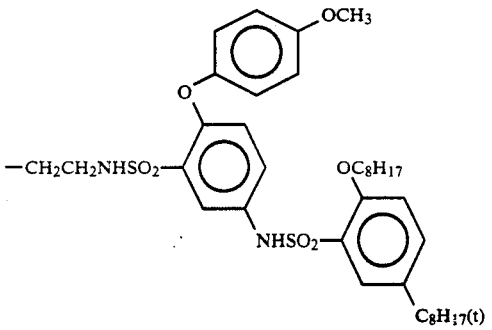 | 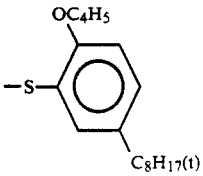 |
| M-20 | 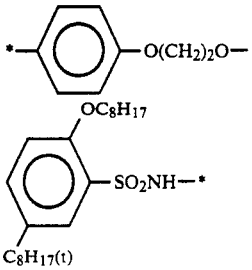 | 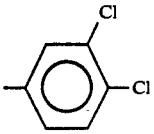 | 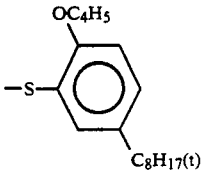 |
| M-21 | 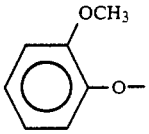 | 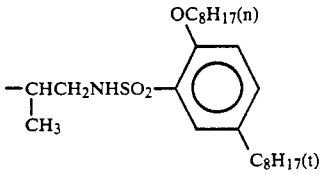 | Cl |
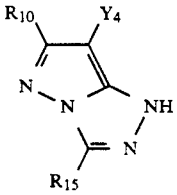
| | | | |
|---|---|---|---|
| M-22 | $CH_3-$ | 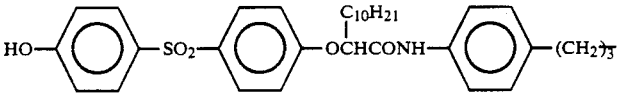 | Cl |
| M-23 | $CH_3-$ | 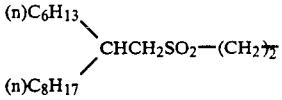 | Cl |
| M-24 | 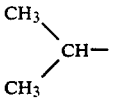 | 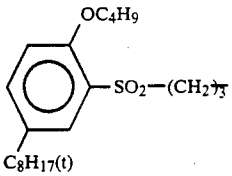 | Cl |
| M-25 | 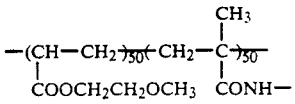 | 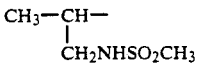 | Cl |

-continued
| | | | |
|---|---|---|---|
| M-26 | 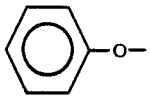 | 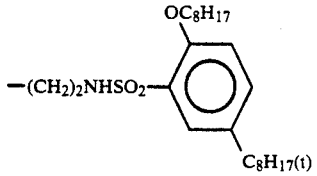 | Cl |
| M-27 | $CH_3$— | 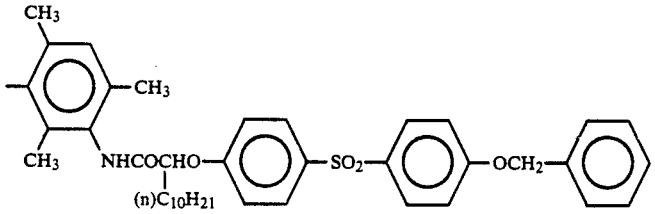 | Cl |
| M-28 | $(CH_3)_3C$— | 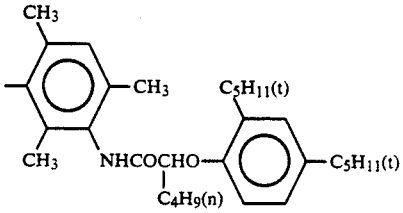 | Cl |
| M-29 | 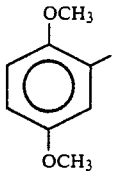 | 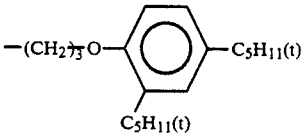 | Cl |
| M-30 | $CH_3$— | 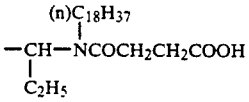 | Cl |
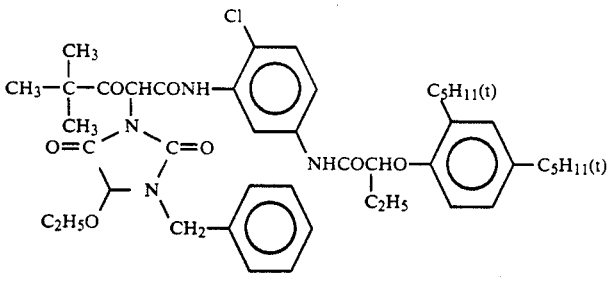
(Y-1)
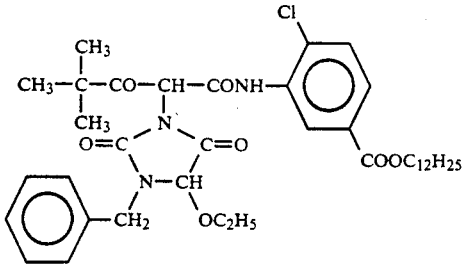
(Y-2)

-continued
(Y-3)
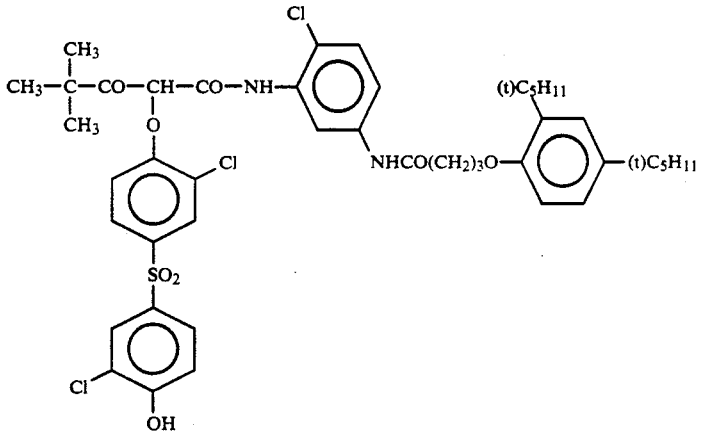
(Y-4)
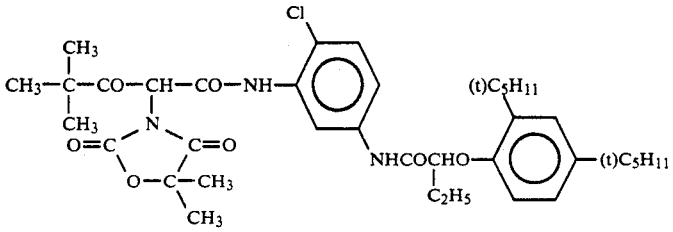
(Y-5)
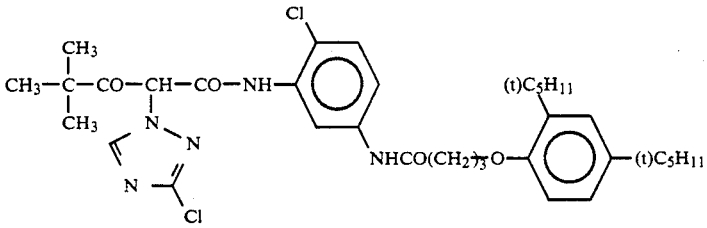
(Y-6)
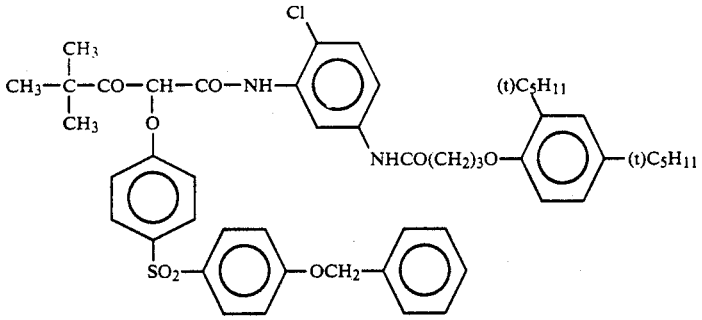
(Y-7)
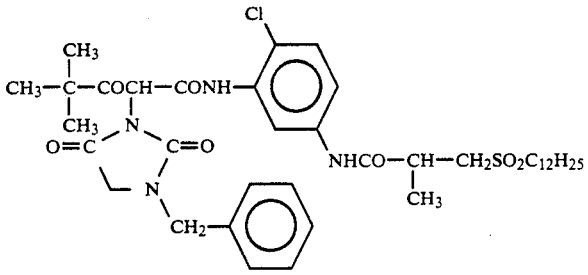

-continued (Y-8)

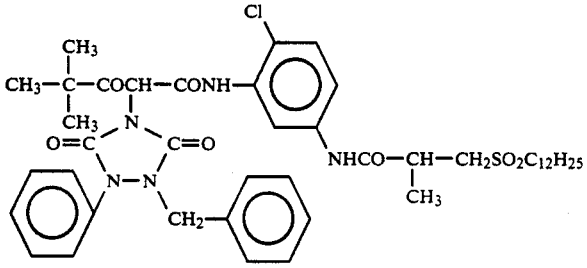

(Y-9)

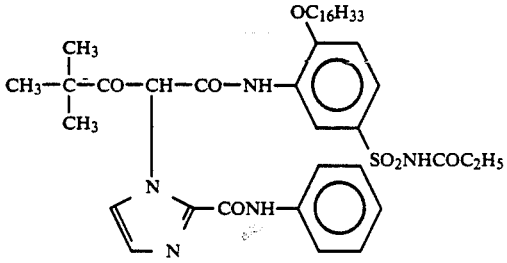

The couplers of formulas (C-I) through (Y) are incorporated in the silver halide emulsion layers of the photosensitive material generally in an amount of from 0.1 to 1.0 mol, preferably from 0.1 to 0.5 mol, per mol of silver halide.

For addition of the couplers to the photosensitive layers in the present invention, a variety of known techniques can be employed. Generally, they can be added by the oil-in-water dispersion technique which is known as the "oil-protect" method. In this method, each coupler is dissolved in a solvent and then dispersed and emulsified in an aqueous solution of gelatin containing a surfactant. As an alternative, water or an aqueous solution of gelatin is added to a coupler solution containing a surfactant so that an oil-in-water dispersion may form through phase transfer. An alkali-soluble coupler can be dispersed by the Fischer dispersion technique. The low boiling organic solvent may first be removed from the coupler dispersion by distillation, noodling or ultrafiltration, and then the residue is mixed with the photographic emulsion.

As the dispersing medium for couplers, it is preferable to use a high boiling organic solvent having a dielectric constant of 2 to 20 (25° C.) and a refractive index of 1.5 to 1.7 (25° C.) and/or a water-insoluble high molecular compound.

As the aforesaid high boiling organic solvent, those which may be represented by the following formulas (A) through (E) are preferably employed.

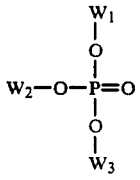

(A)

$W_1-COO-W_2$ (B)

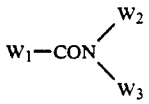

(C)

-continued

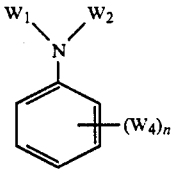

(D)

$W_1-O-W_2$ (E)

In the above formulas, $W_1$, $W_2$ and $W_3$ each is a substituted or unsubstituted alkyl, cycloalkyl, alkenyl, aryl or heterocyclic group; $W_4$ represents $W_1$, $OW_1$ or $S-W_1$; n represents an integer of 1 through 5 and when n is greater than 1, plural $W_4$'s may be the same or different. In formula (E), $W_1$ and $W_2$ may form a fused ring.

The high boiling organic solvent which can be employed in the present invention is not limited to the solvents of formulas (A) through (E) but may be any water-immiscible compound that has a melting point of less than 100° C. and a boiling point of not less than 140° C. and is a good solvent for the coupler. The melting point of the high boiling organic solvent is preferably not higher than 80° C. The boiling point of the high boiling organic solvent is preferably not lower than 160° C. and more preferably not lower than 170° C.

With regard to further information on such high boiling organic solvent, the description on page 137, bottom right col. through page 144, top right col. of JP-A-62-215272 is incorporated herein by reference.

Moreover, these couplers can be used to impregnate a loadable polymer (e.g., as disclosed in U.S. Pat. No. 4,203,716) in the presence or absence of the high boiling organic solvent or be dissolved in a polymer insoluble in water but soluble in an organic solvent and emulsified with an aqueous hydrophilic colloid solution.

Preferably, the homopolymers and copolymers described on pages 12 to 30 of the specification of Laid-open International Patent WO 80/00723 are employed, and the use of an acrylamide polymer is particularly beneficial for color image stabilization.

The photosensitive material according to the present invention may contain a color antifoggant, such as, for example, hydroquinone derivatives, aminophenol derivatives, gallic acid derivatives, and ascorbic acid derivatives.

A variety of color fading inhibitors can be used in the photosensitive material of the present invention. For example, as organic fading inhibitors for cyan, magenta and/or yellow images, there may be mentioned hydroquinone compounds, 6-hydroxychroman compounds, 5-hydroxycoumaran compounds, spirochroman compounds, p-alkoxyphenol compounds, hindered bisphenol and other phenols, gallic acid derivatives, methylene-dioxybenzene compounds, aminophenols, and hindered amines, inclusive of ether or ester derivatives obtainable by silylation or alkylation of the phenolic hydroxy groups of such compounds. Furthermore, metal complex compounds such as, for example, (bis-salicylaldoximato)nickel complex and (bis-N,N-dialkyldithiocarbamato)nickel complex can be used as color fading inhibitors.

Exemplary species of such organic fading inhibitors are mentioned in the specifications of the following patents:

Hydroquinones:

U.S. Pat. Nos. 2,360,290, 2,418,613, 2,700,453, 2,701,197, 2,728,659, 2,732,300, 2,735,765, 3,982,944 and 4,430,425; British Patent 1,363,921, U.S. Pat. Nos. 2,710,801 and 2,816,028, etc.;

6-Hydroxychromans, 5-hydroxycoumarans and spirochromans:

U.S. Pat. Nos. 3,432,300, 3,573,050, 3,574,627, 3,698,909 and 3,764,377, JP-A-52-152225, etc.;

Spiroindans:

U.S. Pat. No. 4,360,589, etc.;

p-Alkoxyphenols:

U.S. Pat. No. 2,735,765, British Patent 2,066,975, JP-A-59-10539, JP-B-57-19765 (the term "JP-B" as used herein refers to an "examined Japanese patent publication"), etc.;

Hindered phenols:

U.S. Pat. No. 3,700,455, JP-A-52-72224, U.S. Pat. No. 4,228,235, JP-B-52-6623, etc.;

Gallic acid derivatives, methylenedioxybenzenes and aminophenols:

U.S. Pat. Nos. 3,457,079 and 4,332,886, JP-B-56-21144, etc.;

Hindered amines:

U.S. Pat. Nos. 3,336,136 and 4,268,593, British Patents 1,326, 889, 1,354,313 and 1,410,846, JP-B-51-1420, JP-A-58-114036, JP-A-59-53846 and JP-A-59-78344, etc.;

Metal complex compounds:

U.S. Pat. Nos. 4,050,938 and 4,241,155, British Patent 2,027,731 (A), etc.

These compounds are coemulsified with the corresponding couplers generally in a proportion of 5 to 100% by weight relative to the coupler, and the emulsions are added to the photosensitive layers. For prevention of thermal and particularly, photodegradation of the cyan color image, it is advantageous to incorporate an ultraviolet absorber in the cyan dye forming layer and adjacent layers on both sides thereof.

Examples of the ultraviolet absorber include aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A-46-2784), cinnamic ester compounds (e.g., those described in U.S. Pat. Nos. 3,705,805 and 3,707,395), butadiene compounds (those described in U.S. Pat. No. 4,045,229) and benzoxidol compounds (e.g., U.S. Pat. Nos. 3,406,070, 3,677,672 and 4,271,307).

Ultraviolet-absorbing couplers (e.g., α-naphthol cyan dye forming couplers) and ultraviolet-absorbing polymers can also be employed. These ultraviolet absorbents may be incorporated into a specific layer by mordanting.

Particularly preferred as the ultraviolet absorbers are aryl-substituted benzotriazole compounds.

The photosensitive material of the present invention may contain filter dyes, such as water-soluble dyes or dyes rendered water-soluble upon photographic processing, for the prevention of irradiation or halation or for other purposes in the hydrophilic colloid layers. Examples of such dyes are oxonol dyes, hemioxonol dyes, styryl dyes, merocyanine dyes, cyanine dyes and azo dyes. Particularly useful are oxonol dyes, hemioxonol dyes and merocyanine dyes.

The binder or protective colloid which can be used in the emulsion layers of the photosensitive material used in the present invention includes various hydrophilic colloids, as used independently or in combination with gelatin, but the use of gelatin is advantageous.

For the purposes of the present invention, the gelatin may be lime-processed gelatin or acid-processed gelatin. For detailed information on the process of producing gelatin, Arthor Veis, *The Macromolecular Chemistry of Gelatin* (Academic Press, 1964) can be consulted.

The support which can be used in the present invention includes a variety of transparent films, such as cellulose nitrate film and polyethylene terephthalate film, and reflective supports, which are commonly used in the fabrication of photographic materials.

For the purposes of the present invention, the use of a reflective support is preferred.

The term "reflective support" represents, in the context of the present invention, any support designed to increase the sharpness of the dye image formed in the silver halide emulsion layer through enhanced reflectivity. As such, the reflective support includes, for example, a support coated with a hydrophobic resin containing a light-reflecting material, e.g., titanium oxide, zinc oxide, calcium carbonate, calcium sulfate or the like, which is dispersed therein or a support made of a hydrophobic resin containing such a light-reflecting material which is dispersed therein. Thus, the support includes, among others, baryta paper, polyethylene-laminated paper, polypropylene synthetic paper, and various transparent supports, e.g., sheet glass, polyethylene terephthalate, cellulose triacetate, cellulose nitrate and other polyester films, polyamide film, polycarbonate film, polystyrene film, polyvinyl chloride film, etc., as used in combination with a reflective layer or a reflective substance which is incorporated in a support.

As other kinds of reflective supports, those having mirror-reflective or class 2 diffuse-reflecting metal surfaces can also be employed. The spectral reflectance of the metal surface in the visible region of the spectrum is preferably not less than 0.5 and the diffuse reflectivity is preferably imparted by roughening the metal surface or using a metal powder. The metal mentioned above may be, for example, aluminum, tin, silver or magnesium or an alloy of such metals and the surface mentioned above may be a metal surface formed by rolling, vapor deposition or plating, a metal foil or a metal film.

It is particularly advantageous to vapor-deposit such a metal on a heterogeneous substrate. It is preferable to provide a water-resistant resin layer, particularly a thermoplastic resin layer, on the metal surface. An antistatic layer is preferably provided on the side of the support which is opposite to the metal surface. For detailed information on such supports, JP-A-61-210346, JP-A-63-24247, JP-A-63-24251 and JP-A-63-24255, for instance, can be consulted.

These supports can be selectively employed according to the intended use.

With regard to the light-reflective substance, it is good practice to knead a white pigment thoroughly in the presence of a surfactant and to treat the surfaces of pigment particles with a di- to tetrahydric alcohol.

The percent coverage (%) of a finely divided white pigment can be determined most typically by dividing an observed area into 6 $\mu m \times 6$ $\mu m$ unit areas directly adjacent to one another and determining the percent coverage, or percent projection area of the pigment particles, $R_i$. The coefficient of variation can be calculated as the ratio $s/\overline{R}$ where $\overline{R}$ is the mean of $R_i$ values and s is the standard deviation. The number of unit areas to be submitted to this measurement should preferably be not less than 6. The coefficient of variation $s/\overline{R}$ can thus be calculated using the formula $$\overline{s/R} = \frac{\sqrt{\dfrac{\sum_{i=1}^{n} (R_i - \overline{R})^2}{n-1}}}{\dfrac{\sum_{i=1}^{n} R_i}{n}}$$

In the practice of the present invention, the coefficient of variation for the percent pigment coverage determined in the above manner should preferably be not more than 0.15, more preferably not more than 0.12. When the coefficient is 0.08 or less, the pigment can be said to give a substantially "homogenous" dispersion.

After exposure, the photosensitive material of the present invention for color photography is preferably subjected to color development, bleach/fixing, and rinsing (or stabilization). The bleaching and fixation may be carried out in the same bath or separately.

The color developer to be used in the practice of the present invention contains an aromatic primary amine developing agent which is widely known. Preferred examples are p-phenylenediamine compounds. Typical examples are shown below. They are, however, by no means limitative of the scope of the present invention.

D-1 N,N-Diethyl-p-phenylenediamine
D-2 2-Amino-5-diethylaminotoluene
D-3 2-Amino-5-(N-ethyl-N-laurylamino)toluene
D-4 4-[N-ethyl-N-(β-hydroxyethyl)amino]aniline
D-5 2-Methyl-4-[N-ethyl-N-(β-hydroxyethyl)amino]-aniline
D-6 4-Amino-3-methyl-N-ethyl-N-[β-(methanesulfonamido)ethyl]aniline
D-7 N-(2-Amino-5-diethylaminophenylethyl(methanesulfonamide
D-8 N,N-Dimethyl-p-phenylenediamine
D-9 4-Amino-3-methyl-N-ethyl-N-methoxyethylaniline
D-10 4-Amino-3-methyl-N-ethyl-N-β-ethoxyethylaniline
D-11 4-Amino-3-methyl-N-ethyl-N-β-butoxyethylaniline Of the above mentioned p-phenylenediamine compounds, 4-amino-3-methyl-N-ethyl-N-[β-(methanesulfonamido)ethyl]aniline (D-6) is particularly preferred. If necessary, or where appropriate, a plurality of developing agents may be used in admixture. The p-phenylene-diamine compound may be in the form of salts, such as the sulfate, hydrochloride, sulfite or p-toluenesulfonate. The aromatic primary amine developing agent is used preferably in an amount of about 0.1 to about 20 g, more preferably about 0.5 g to about 10 g, per liter of the developer.

In practicing the invention, the use of a developer substantially free of benzyl alcohol is preferred. The phrase "substantially free" means that the benzyl alcohol concentration should preferably be not more than 2 ml/liter, more preferably not more than 0.5 ml/liter, and most preferably zero (completely free of benzyl alcohol).

More preferably, the developer to be used in the practice of the present invention should be substantially free of sulfite ion. The sulfite ion functions as a preservative for the developing agent, but at the same time solubilizes the silver halide and further reacts with the oxidized product of the developing agent to reduce the dye formation efficiency. It is presumable that the latter effects should cause increased variations in photographic characteristics in continuous processing. The phrase "substantially free" is used to indicate that the sulfite ion concentration should preferably be not more than $3.0 \times 10^{-3}$ mol/liter, most preferably zero (completely free of sulfite ion). It is to be noted, however, that the above discussion does not apply to the sulfite ion contained in very small amounts in processing kits which contain a developing agent in a concentrated form before the preparation of a processing solution.

While the developer to be used in the practice of the present invention should preferably be substantially free of sulfite ion, the developer should more preferably be also substantially free of hydroxylamine. This is because hydroxylamine, which can serve as a preservative for developers, by itself has silver developing activity which can presumably exerting an influence on photographic characteristics when present at sufficient concentration. The phrase "substantially free of hydroxylamine" is used to mean that the hydroxylamine concentration should preferably be not more than $5.0 \times 10^{-3}$ mol/liter, and most preferably zero (completely free of hydroxylamine).

More preferably, the developer to be used in the practice of the present invention should contain an organic preservative in lieu of the above mentioned hydroxylamine or sulfite ion.

The term "organic preservative" as used herein means any and all organic compounds which, when added to a processing solution for color photographic light-sensitive materials, would reduce the rate of degradation of the aromatic primary amine color developing agent. Thus, an organic preservative is an organic compound which has the ability to inhibit atmospheric or other oxidation of color developing agents.

Particularly useful organic preservatives are hydroxylamine compounds (exclusive of hydroxylamine itself; hereinafter, the term hydroxylamine compounds shall exclude hydroxylamine), hydroxamic acids, hydrazines, hydrazides, phenols, α-hydroxyketones, α-aminoketones, carbohydrates, monoamines, diamines, polyamines, quaternary ammonium salts, nitroxy radicals, alcohols, oximes, diamide compounds and condensed cyclic amines, among others. These compounds are disclosed, for instance, in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657 and JP-A-63-44656, U.S. Pat. Nos. 3,615,503 and 2,494,903, JP-A-52-143020 and JP-B-48-30496.

Other preservatives that may be contained in the developer where appropriate include various metals described in JP-A-57-44148 and JP-A-57-53749, salicylic acids described in JP-A-59-180588, alkanolamines described in JP-A-54-3532, polyethyleneimines described in JP-A-56-94349 and aromatic polyhydroxy compounds described in U.S. Pat. No. 3,746,544. The addition of an alkanolamine such as triethanolamine, a dialkylhydroxylamine such as diethylhydroxylamine, a hydrazine derivative or an aromatic polyhydroxy compound is particularly preferred.

Among the organic preservatives mentioned above, hydroxylamine compounds and hydrazine derivatives (hydrazines and hydrazides) are particularly preferred. These compounds and derivatives are fully discussed in JP-A-63-301947, JP-A-1-186939, JP-A-1-186940, JP-A-1-187557, for instance.

For improving the stability of the color developer, and therefore for improving the stability in continuous processing, the combined use of such a hydroxylamine compound or hydrazine derivative and an amine is preferred.

Examples of the amine include cyclic amines such as those described in JP-A-63-239447, amines such as those described in JP-A-63-128340, and amines such as those described in JP-A-1-186939 and JP-A-1-187557.

In practicing the present invention, the color developer should preferably contain chloride ion in an amount of from $3.5\times10^{-2}$ to $1.5\times10^{-1}$ mol/liter, more preferably $4\times10^{-2}$ to $1\times10^{-1}$ mol/liter. Chloride ion concentrations exceeding $1.5\times10^{-1}$ mol/liter may disadvantageously reduce the rate of development, and therefore are inadequate for rapid development with a high maximum density, which is an object of the present invention. Chloride ion concentrations below $3.5\times10^{-2}$ mol/liter are undesirable in terms of fog prevention.

In practicing the present invention, the color developer should preferably contain bromide ion in a concentration of from $3.0\times10^{-5}$ to $1.0\times10^{-3}$, more preferably $5.0\times10^{-5}$ to $5\times10^{-4}$ mol/liter. Bromide ion concentrations exceeding $1.0\times10^{-3}$ mol/liter may possibly retard development while concentrations below $3.0\times10^{-5}$ mol/liter may fail to satisfactorily prevent fogging.

The chloride ion and bromide ion may be added directly to the developer or may be caused to migrate from the photosensitive material into the developer during development.

Examples of the chloride ion source which are suitable for direct addition to the color developer are sodium chloride, potassium chloride, ammonium chloride, lithium chloride, nickel chloride, magnesium chloride, manganese chloride, calcium chloride and cadmium chloride. Of these, sodium chloride and potassium chloride are preferred.

The chloride ion may be supplied from the fluorescent whitener contained in the developer.

The bromide ion source is, for example, sodium bromide, potassium bromide, ammonium bromide, lithium bromide, calcium bromide, magnesium bromide, manganese bromide, nickel bromide, cadmium bromide, cerium bromide or thallium bromide. Among these, potassium bromide and sodium bromide are preferred.

In cases where the chloride ion and bromide ion are to be eluted from the photosensitive material during development processing, they both may be supplied from the emulsion or any source other than the emulsion.

The color developer to be used in the practice of the present invention preferably has a pH of 9 to 12, more preferably 9 to 11.0. The color developer may further contain other compounds which may be selected from the known developer components.

The above mentioned pH is preferably established with buffers. Among the buffers useful for this purpose are carbonate salts, phosphate salts, borate salts, tetraborate salts, hydroxybenzoate salts, glycine salts, N,N-dimethylglycine salts, leucine salts, norleucine salts, guanine salts, 3,4-dihydroxyalanine salts, alanine salts, aminobutyrate salts, 2-amino-2-methyl-1,3-propanediol salts, valine salts, proline salts, trishydroxymethylaminomethane salts and lysine salts.

Carbonate salts, phosphate salts, tetraborate salts and hydroxybenzoate salts are particularly preferred since these buffers are inexpensive and show good solubility and good buffering characteristics at a pH of 9.0 or higher. In addition, when added to the color developer, these salts will not produce any adverse influence (e.g., causing fog) on photographic characteristics.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sufo-2-hydroxybenzoate (sodium 5-sulfosalicylate) and potassium 5-sulfo-2-hydroxybenzoate (potassium 5-sulfosalicylate). However, these examples are by no means limitative of the scope of the present invention.

The level of addition of the above buffer or buffers to the color developer is preferably not less than 0.1 mol/liter, more preferably within the range of 0.1 to 0.4 mol/liter.

Furthermore, various chelating agents can be used in the color developer as precipitation inhibitors for calcium and magnesium or for improving the stability of the color developer. Examples of these agents include nitrilotriacetic acid, diethylenetriaminepentaacetic acid, ethylenediaminetetraacetic acid, nitrilotrimethylenephosphonic acid, ethylenediamine-N,N,N',N'-tetramethylenesulfonic acid, trans-cyclohexanediaminetetraacetic acid, 1,2-diaminopropanetetraacetic acid, glycol ether diaminetetraacetic acid, ethylenediamineortho-hydroxyphenylacetic acid, 2-phosphonobutane-1,2,4-tricarboxylic acid, 1-hydroxyethylidene-1,1-diphosphonic acid and N,N,-bis(2-hydroxybenzyl)ethylenediamine-N,N'-diacetic acid. However, these examples are by no means limitative of the scope of the present present invention.

The level of addition of thee chelating agents is sufficient if the metal ion or ions in the color developer can be sequestered to a satisfactory extent. For instance, an addition level of about 0.1 to 10 g per liter will be sufficient.

The color developer may contain a development accelerator, if desired.

Suitable development accelerators include thioether compounds described, for instance, in JP-B-37-16088, JP-B-37-5987, JP-B-38-7826, JP-B-44-12380 and JP-B-45-9019 and in U.S. Pat. No. 3,813,247, p-phenylenediamine compounds described, for instance, in JP-A-52-49829 and JP-A-50-15554, quaternary ammonium salts described, for instance, in JP-B-44-30074 and JP-A-50-137726, JP-A-56-156826 and JP-A-52-43429, amine compounds described, for instance, in U.S. Pat. Nos. 2,494,903, 3,128,182, 4,230,796 and 3,253,919, JP-B-41-11431 and U.S. Pat. Nos. 2,482,546, 2,596,926, and 3,582,346, polyalkylene oxides described in JP-B-37-16088, JP-B-42-25201, JP-B-41-11431 and JP-B-42-23883 and U.S. Pat. Nos. 3,128,183 and 3,532,501, 1-phenyl-3-pyrazolidones, imidazoles and the like.

In the practice of the present invention, an antifoggant may be used where appropriate, such as an alkali metal halide (e.g., sodium chloride, potassium bromide, potassium iodide) or an organic antifoggant. Typical examples of the organic antifoggant are nitrogen-containing heterocyclic compounds, such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindoline and adenine.

The color developer that can be used in the practice of the present invention preferably contains an optical or fluorescent whitener. Preferred as the optical whitener are 4,4'-diamino-2,2'-disulfostilbene compounds. The addition level is 0 to 5 g per liter, preferably 0.1 to 4 g per liter of color developer.

If necessary, various surfactants, such as alkylsulfonic acid type, arylsulfonic acid type, aliphatic carboxylic acid type and aromatic carboxylic acid type surfactants, may be incorporated into the developer.

The processing temperature for the color developer used in the practice of the present invention generally is from 20° to 50° C., preferably 30° to 40° C. The processing time generally is 90 seconds to 5 minutes, preferably 90 seconds to 3.5 minutes. The replenishment volume should preferably be as small as possible and suitably is from 20 to 600 ml, preferably from 50 to 300 ml, more preferably from 60 to 200 ml, and most preferably from 60 to 150 ml, per square meter of the photosensitive material.

The process for removal of silver that can be employed in the present invention may generally be any of bleach, then fix; or fix, then bleach-fix; or bleach, then bleach-fix; or bleach-fix, etc.

Bleaching solutions, bleaching/fixing solutions and fixing solutions which can be used in the practice of the present invention are described below.

In the bleaching bath or bleach/fixing bath, any bleaching agent may be employed. Preferred, however, are organic iron(III) complex salts (e.g., complexes with aminopolycarboxylic acids, such as ethylenediaminetetraacetic acid and diethylenetriaminepentaacetic acid, aminopolyphosphonic acids, phosphonocarboxylic acids, and organic phosphonic acids), organic acids, such as citric acid, tartaric acid and malic acid, presulfate salts, and hydrogen peroxide, among others.

Of the above mentioned examples, organic iron(III) salts are particularly preferred for rapid processing and prevention of environmental pollution. Specifically, the aminopolycarboxylic acids, aminopolyphosphonic acids and organic phosphonic acids, inclusive of salts thereof, useful for forming organic chelates of iron(III) include, among others, ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, glycol ether diaminetetraaetic acid, and sodium, potassium, lithium and ammonium salts of these acids. Among these compounds, iron(III) complexes with ethylenediaminetetraacetic acid, diethylenetriaminepentaacetic acid, cyclohexanediaminetetraacetic acid, 1,3-diaminopropanetetraacetic acid and methyliminodiacetic acid are preferred for high bleaching power.

The ferric ion complexes may be used either as such in the complex salt form or prepared in situ in the solution using a ferric salt, such as ferric ammonium sulfate or ferric phosphate, and a chelating agent, such as an aminopolycarboxylic acid, aminopolyphosphonic acid or phosphonocarboxylic acid. The chelating agent may be used in excess of the quantity required for ferric ion chelate formation. Among the iron complexes, aminopolycarboxylic acid-iron chelates are preferred. The addition level is 0.01 to 1.0 mol/liter, preferably 0.05 to 0.50 mol/liter.

The bleaching bath, bleach/fixing bath and/or preceding baths may contain various compounds as bleaching accelerators. Thus, for example, the following compounds, each excellent in bleaching power, may preferably be used: mercapto group or disulfide bond-containing compounds described in U.S. Pat. No. 3,893,858, German Patent 1,290,812, JP-A-53-95630 and Research Disclosure No. 17129 (July, 1978), thiourea compounds described in JP-B-45-8506, JP-A-52-20832 and JP-A-53-32735 and U.S. Pat. No. 3,706,561, and halogen compounds, such as those of iodine and bromine ion.

The bleaching solutions or bleaching/fixing solutions which are suitable in the practice of the present invention may further contain a rehalogenating agent, such as a bromide (e.g., potassium bromide, sodium bromide, ammonium bromide), a chloride (e.g., potassium chloride, sodium chloride, ammonium chloride) or an iodide (e.g., ammonium iodide). If desired or where appropriate, one or more inorganic acids, organic acids, or alkali metal or ammonium salts of these, which have pH buffering activity, for example, borax, sodium metaborate, acetic acid, sodium acetate, sodium carbonate, potassium carbonate, phosphorous acid, phosphoric acid, sodium phosphate, citric acid, sodium citrate and tartaric acid, and/or one or more corrosion inhibitors, such as ammonium nitrate and guanidine, may be added to the solutions.

The fixing agents to be used in the bleaching/fixing solutions or fixing solutions are known compounds, namely, water-soluble, silver halide-solubilizing agents such as thiosulfates (e.g., sodium thiosulfate, ammonium thiosulfate), thiocyanates (e.g., sodium thiocyanate, ammonium thiocyanate), thioether compounds (e.g., ethylenebisthioglycolic acid, 3,6-dithia-1,8-octanediol) and thioureas. These may be used either alone or in combination.

Furthermore, special purpose bleaching/fixing solutions such as described in JP-A-55-155354 and comprising the combination of a large amount of a fixing agent and a halide such as potassium iodide may also be used. In the practice of the present invention, the use of a thiosulfate, particularly ammonium thiosulfate, is preferred.

The level of addition of the fixing agent is preferably from 0.3 to 2 mols per liter, more preferably 0.5 to 1.0 mol per liter. The bleaching/fixing or fixing solutions should preferably have a pH of from 3 to 10, more preferably 5 to 9.

Furthermore, the bleaching/fixing solutions may contain various fluorescent whiteners, antifoaming agents, surfactants, polyvinylpyrrolidone and/or organic solvents (e.g., methanol).

The bleaching/fixing or fixing solutions preferably contain, as a preservative, a sulfite ion-releasing compound such as a sulfite (e.g., sodium sulfite, potassium sulfite), a bisulfite (e.g., ammonium bisulfite, sodium bisulfite, potassium bisulfite) or a metabisulfite (e.g., potassium metabisulfite, sodium metabisulfite, ammonium metabisulfite). The addition level is, when expressed in terms of sulfite ion concentration, about 0.02 to 0.05 mol/liter, more preferably 0.04 to 0.40 mol/liter.

While sulfites are generally used as preservatives, ascorbic acid, carbonyl-bisulfite adducts and carbonyl compounds may also be used.

Furthermore, buffers, fluorescent whiteners, chelating agents, antifoaming agents, fungicides and other additives may be added to such solutions when desired or where appropriate.

Desilvering by fixing or bleaching/fixing is generally followed by washing with water and/or processing for stabilization.

The quantity of water to be used in the washing step can be selected within a broad range depending on the characteristics of the photosensitive material (e.g., depending on couplers and other materials used), the intended use thereof, the washing water temperature, the number of washing tanks (number of stages), countercurrent or cocurrent replenishment, and other conditions. The relationship between the number of tanks and the quantity of water in a multistage countercurrent system can be determined by the method described in Journal of the Society of Motion Picture and Television Engineers, 64, 248–253 (May, 1955). Generally, the number of stages in a multistage countercurrent system is preferably 2 to 6, more preferably 2 to 4.

The multistage countercurrent system can markedly reduce the quantity of water to be used for washing, for instance, to a level of 0.5 to 1 liter or less per square meter of the photosensitive material, thus leading to a reduced waste load.

However, in said system, increases in the residence time of water in tanks may produce the problems of bacterial growth and deposition of the resulting floating matter on the photosensitive material. To solve such problems, the method comprising reducing the calcium and magnesium concentrations, which is described in JP-A-62-288838, can be used very effectively.

It is also possible to use biocides such as thiabendazoles and isothiazolone compounds described in JP-A-57-8542, chloride microbicides such as chlorinated sodium isocyanurate described in JP-A-61-120145, benzotriazole compounds described in JP-A-61-267761, copper ion, and those described in Hiroshi Horiguchi, Bokin Bobai no Kagaku (Chemistry of Bacterium and Fungus Control), Sankyo Shuppan, 1986; Eisei Gijutsu Kai (Sanitation Technology Association) (ed.), Biseibutsu no Mekkin, Sakkin, Bobai Gijutsu (Techniques of Microbial Sterilization, Microbe Killing and Mold Control), Kogyo Gijutsu Kai, 1982; and Research Society of Antibacterial and Antifungal Agents, Japan (ed.), Bokin Bobaizai Jiten (Cyclopedia of Antibacterial and Antifungal Agents), 1986.

Furthermore, the rinsing water may contain a surfactant as a drainage promoter, and/or a chelating agent, typically EDTA, as a water softener.

The stabilization step may follow either the above washing step or directly the silver removal step omitting the washing step mentioned above. The stabilizing solution contains a compound or compounds capable of stabilizing images, for example, aldehyde compounds, typically formalin, buffers for adjusting the pH to a level suited for dye stabilization, and ammonium compounds. Various bactericides and fungicides such as those mentioned above may be used for inhibiting bacterial growth in the stabilizing solution and rendering treated photosensitive materials resistant to fungi.

Furthermore, surfactants, fluorescent whiteners and/or hardeners may be used. When, in the processing of the photosensitive material according to the present invention, the stabilization step directly follows the silver removal step without the interposition of any washing step, any of the known methods described, for instance, in JP-A-57-8543, JP-A-58-14834 and JP-A-60-220345 can be employed.

It is also a preferred practice to use such chelating agents as 1-hydroxyethylidene-1,1-diphosphonic acid and ethylenediaminetetramethylenephosphonic acid, magnesium compounds and/or bismuth compounds.

A so-called rinsing may also be used as the washing or stabilizing solution to be used following silver removal.

The pH to be employed in the washing or stabilization step is preferably from 4 to 10, more preferably from 5 to 8. The temperature to be employed may vary depending on the intended use and characteristics of the photosensitive material and on other factors. Generally, however, it is from 15° to 45° C., preferably from 20° to 40° C. Although the time to be spent for this step is not critical, a shorter time is desired for reducing the processing time. Thus, a period of 15 to 5.5 seconds, in particular 30 to 3.5 seconds, is preferred. The replenishing quantity should preferably be as small as possible from the viewpoints of running cost, effluent reduction, ease of handling and so on.

A preferred replenishment quantity is 0.5 to 50 times, preferably 3 to 40 times, the carry-overs from the preceding bath per unit surface area of the photosensitive material, or not more than 1 liter, preferably not more than 500 ml, per square meter of the photosensitive material. The replenishment may be continuous or intermittent.

The solution used in the washing and/or stabilization step may be used again in the preceding step. For example, the overflow of the washing water whose quantity is cut down by employing a multistage countercurrent system may be introduced into the preceding bleach/fixing bath while supplementing a concentrated bleaching/fixing solution to the bath. In this way, the quantity of waste fluid can be reduced.

The following examples are provided by way of illustration to further explain the principles of the present invention. These examples are merely illustrative and are not to be understood as limiting the scope and underlying principles of the present invention in any way. All percentages referred to herein are by weight unless otherwise indicated.

EXAMPLE 1

Using a support prepared by laminating a polyethylene film to either side of a substrate paper sheet, a multilayer color printing paper of the following construction was fabricated. The coating compositions were prepared in the following manner.

Preparation of the first layer coating composition

First, 19.1 g of yellow coupler (ExY), 4.4 g of color image stabilizer (Cpd-1) and 1.4 g of color image stabilizer (Cpd-7) were dissolved by addition of 27.2 cc of ethyl acetate and 8.2 g of solvent (Solv-1) and the resulting solution was dispersed and emulsified in 185 cc of a 10% aqueous solution of gelatin containing 8 cc of 10% sodium dodecylbenzenesulfonate. Separately, blue-sensitive sensitizing dyes shown below were added to a silver chlorobromide emulsion comprised of a mixture of a large grain sized emulsion and a small grain sized emulsion (a 3:7 (silver mol ratio) mixture of a large size emulsion of AgBrCl, cubic, average grain size 0.88 μm and coefficient of variation 0.08, and a small size emulsion, cubic, average grain size 0.70 μm and coefficient of variation 0.10; in each emulsion, 0.2 mol. % of silver bromide was locally present on the grain surface) in a proportion of $2.0\times10^{-4}$ mols/mol Ag to the larger sized grain emulsion and of $2.5\times10^{-4}$ mols/mol Ag to the smaller sized grain emulsion and the mixture of the emulsions was subjected to sulfur sensitization. This emulsion was mixed with the emulsified dispersion prepared above to give the first layer coating composition.

The second to the seventh coating compositions were also prepared in a similar manner as the first layer coating composition. As the gelatin hardener for each layer, 1-hydroxy-3,5-dichloro-s-triazine sodium salt was used.

The following spectral sensitizing dyes were used in the respective layers.

Blue-sensitive emulsion layer

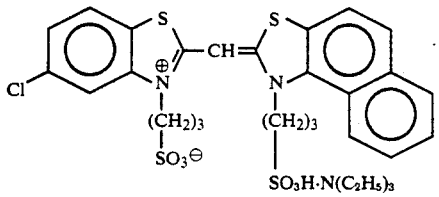

-continued

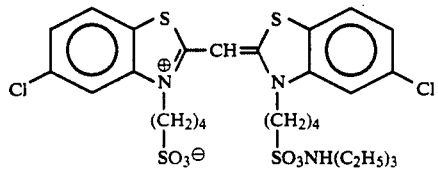

(each added at the level of $2.0\times10^{-4}$ mols/mol Ag to the larger sized grain emulsion and of $2.5\times10^{-4}$ mols/mol Ag to the smaller sized grain emulsion)

Green-sensitive emulsion layer

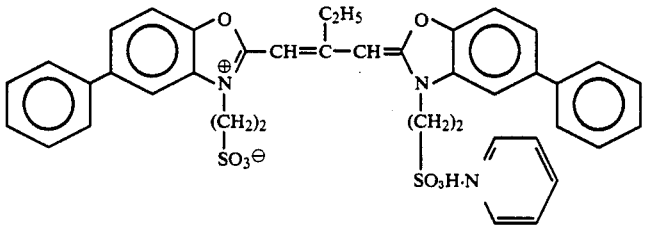

(added at the level of $4.0\times10^{-4}$ mols/mol Ag to the larger sized grain emulsion and of $5.6\times10^{-4}$ mols/mol Ag to the smaller sized grain emulsion) and

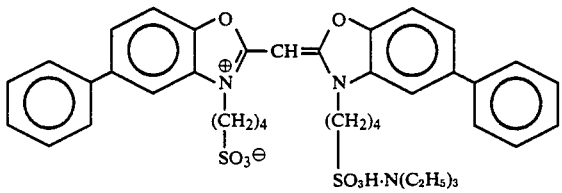

(added at the level of $7.0\times10^{-5}$ mols/mol Ag to the larger sized emulsion and of $1.0\times10^{-5}$ mols/mol Ag to the smaller sized grain emulsion)

Red-sensitive emulsion layer

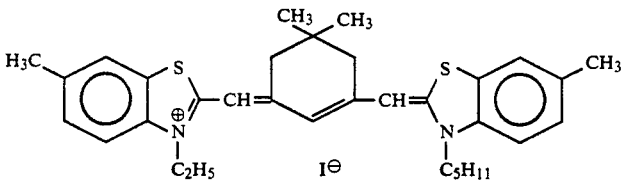

(added at the level of $0.9\times10^{-4}$ mols/mol Ag to the larger sized grain emulsion and of $1.1\times10^{-4}$ mols/mol Ag to the smaller sized grain emulsion)

To the red-sensitive emulsion layer, the following compound was added at the level of $2.6\times10^{-3}$ mols/mol of silver halide.

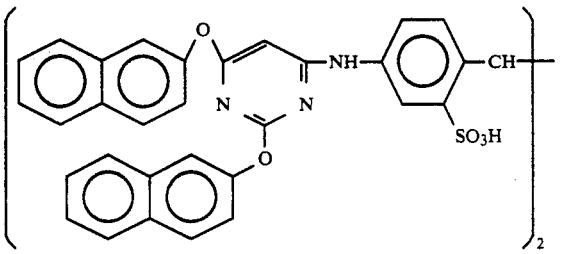

Furthermore, to the blue-sensitive layer, green-sensitive layer and red-sensitive layer, 1-(5-methylureidophenyl)-5-mercaptotetrazole was added at the levels of $8.5\times10^{-5}$ mols, $7.7\times10^{-4}$ mols and $2.5\times10^{-4}$ mols, respectively, based on each mol of silver halide.

For prevention of irradiation, the following dyes were added to the emulsion layers.

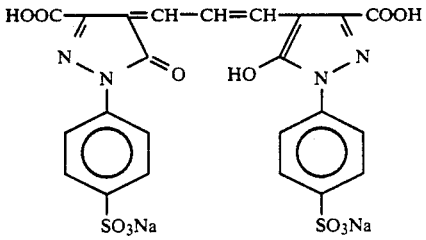

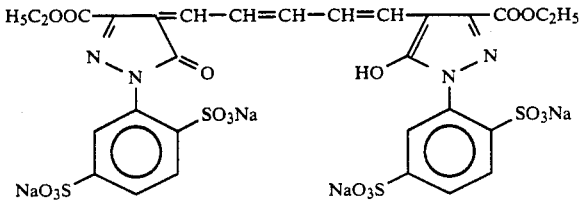

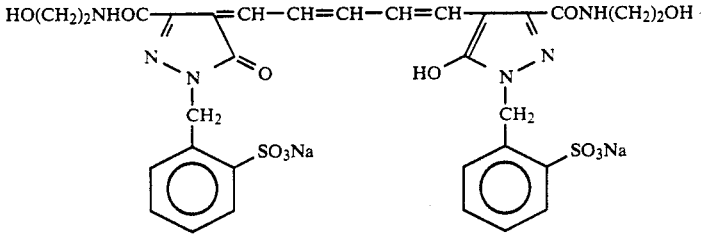

and

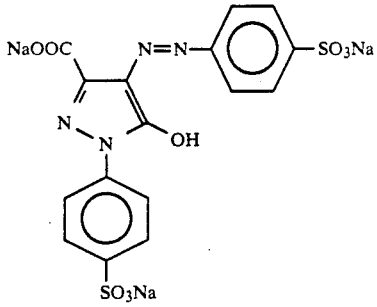

Furthermore, to the blue-sensitive emulsion layer and the green-sensitive emulsion layer, 4-hydroxy-6-methyl-1,3,3a,7-tetraazaindene was added at the level of $1\times10^{-4}$ mols and $2\times10^{-4}$ mols, respectively, based on each mol of silver halide.

As preservatives, the following compounds were used (the figure in parentheses denotes the coating amount).

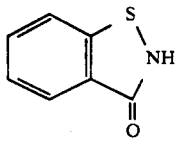

(25.0 mg/m²)

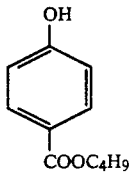

(50.0 mg/m²)

Layer Construction

The compositions of the respective layers are shown below. Each figure denotes the coating amount (g/m²). As to the silver halide emulsion, the figure denotes the coating amount on an Ag basis.

| | |
|---|---|
| First Layer (blue-sensitive layer) | |
| Silver chlorobromide emulsion (mentioned hereinbefore) | 0.30 |
| Gelatin | 1.86 |
| Yellow coupler (ExY) | 0.82 |
| Color image stabilizer (Cpd-1) | 0.19 |
| Solvent (Solv-1) | 0.35 |
| Color image stabilizer (Cpd-7) | 0.06 |
| Second Layer (color mixing inhibition layer) | |
| Gelatin | 0.99 |
| Color mixing inhibitor (Cpd-5) | 0.08 |
| Solvent (Solv-1) | 0.16 |
| Solvent (Solv-4) | 0.08 |

Sample 101 was prepared by the above method.

Based on Sample 101, Samples 102 through 108 were prepared by adding each of the compounds shown in Table 1 to the third layer (green-sensitive layer).

The photographic characteristics of these samples were evaluated by the following test.

First, each sample was exposed to the extent that 30% of its silver will be developed. Using a paper processing machine, each exposed sample was continuously processed (running test) until twice the tank capacity of the color developer was replenished. Then, using the running solution, sensitometry was carried out.

Then, using a sensitomer (Fuji Photo Film Co., Type FWH, light source color temperature 3,200° K), each sample was exposed stepwise for sensitometry through the blue, green and red filters. This exposure was performed to insure an exposure amount of 250 CMS at an exposure time of 1/10 seconds.

TABLE 1

| Sample | Compound Added to Third Layer (green-sensitive layer)* | Level of Addition (g/m²) |
|---|---|---|
| 101 | — | — |
| 102 | Ia-31 | 0.01 |
| 103 | Ia-31 | 0.03 |
| 104 | Ia-31 | 0.10 |
| 105 | Ia-36 | 0.03 |
| 106 | IIa-5 | 0.03 |
| 107 | Ia-31 | 0.03 |
| | IIIa-1 | 0.02 |
| 108 | Ia-31 | 0.03 |
| | IIIa-31 | 0.02 |

*: Coemulsified with Solv-2, magenta coupler, Cpd-3 and Cpd-9.

Each exposed sample was stored under refrigerated conditions (5° C.) or at room temperature (25° C.) for week and the development was carried out by controlling the transport speed so that the color developing time was 45, 90 or 135 seconds.

The time and other parameters of the respective processing steps at the color development time of 45 seconds are shown below.

| Processing Step | Temperature (°C.) | Time (sec) | Replenisher* (ml) | Tank Capacity (liter) |
|---|---|---|---|---|
| Color development | 35 | 45 | 161 | 17 |
| Bleach-fix | 30–35 | 45 | 215 | 17 |
| Rinse (1) | 30–35 | 20 | — | 10 |

-continued

| Processing Step | Temperature (°C.) | Time (sec) | Replenisher* (ml) | Tank Capacity (liter) |
|---|---|---|---|---|
| Rinse (2) | 30–35 | 20 | — | 10 |
| Rinse (3) | 30–35 | 20 | 350 | 10 |
| Drying | 70–80 | 60 | | |

*: The replenisher amount is the volume replenished per m² of the photosensitive material.

(Rinse: a 3-tank countercurrent ystem of (3) to (1)

The compositions of the respective processing baths are as follows.

| Color developer | Tank Solution | Replenisher |
|---|---|---|
| Water | 800 ml | 800 ml |
| Ethylenediamine-N,N,N,N-tetramethylenephosphonic acid | 1.5 g | 2.0 g |
| Postassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)hydrazine | 5.5 g | 7.0 g |
| Fluorescent whitening agent (WHITEX 4B, Sumitomo Chemical) | 1.0 g | 2.0 g |
| Water to make | 1,000 ml | 1,000 ml |
| pH (25° C.) | 10.05 | 10.45 |

Bleach fix bath
(the same for tank solution and replenisher)

| | |
|---|---|
| Water | 400 ml |
| Ammonium thiosulfate (70%) | 100 ml |
| Sodium sulfite | 17 g |
| Ammonium Fe(III) ethylenediaminetetraacetate | 55 g |
| Disodium ethylenediaminetetraacetate | 5 g |
| Ammonium bromide | 40 g |
| Water to make | 1,000 ml |
| pH (25° C.) | 6.0 |

Rinse bath (the same for tank solution and replenisher)
Deionized water (Ca and Mg not more than 3 ppm each)

Each processed sample was measured for color density and the sensitivity and Dmin values were determined. The sensitivity was defined as the reciprocal of the exposure giving a color density higher than Dmin by 1.5, and the change in sensitivity due to storage of each exposed sample was expressed as the relative sensitivity of the sample stored at room temperature with the sensitivity of the sample stored under refrigerated conditions being taken as 100. In addition, the processed sample was stored in an environment of 60° C. and 70% R.H. for 7 days and the color density was then measured to determine the Dmin value. The stain was expressed by the difference found by subtracting the Dmin value immediately following development from the Dmin value after 7 days of storage. The results are set forth in Table 2.

TABLE 2

| Sample | Stain Developing Time 45 sec | 90 sec | 135 sec | Sensitivity of Exposed Samples after Storage at Room Temperature Developing Time 45 sec | 90 sec | 135 sec |
|---|---|---|---|---|---|---|
| 101 | 0.17 | 0.21 | 0.25 | 99 | 100 | 101 |
| 102 | 0.01 (0.16) | 0.01 (0.20) | 0.01 (0.24) | 89 | 100 | 101 |
| 103 | 0.00 (0.17) | 0.00 (0.21) | 0.00 (0.25) | 82 | 99 | 100 |
| 104 | 0.00 (0.17) | 0.00 (0.21) | 0.00 (0.25) | 80 | 98 | 99 |
| 105 | 0.01 (0.16) | 0.01 (0.20) | 0.01 (0.24) | 83 | 99 | 100 |
| 106 | 0.00 (0.17) | 0.00 (0.21) | 0.00 (0.25) | 81 | 98 | 99 |
| 107 | 0.00 (0.17) | 0.00 (0.21) | 0.00 (0.25) | 85 | 100 | 101 |
| 108 | 0.00 (0.17) | 0.00 (0.21) | 0.00 (0.25) | 84 | 99 | 101 |

Note)
The figures in the enclosures represent the test results demonstrating the effect of the present invention. The figures in parentheses denote the magnitude of decrease in stain in each sample relative to Sample 101.

It will be apparent from the data in this table that the photosensitive materials containing compounds of formulas (I) through (III) suffer marked decrease in sensitivity during storage after exposure, but surprisingly these changes were markedly precluded by performing development for not less than 90 seconds, insuring a color image in which the onset of stain after development has been effectively inhibited.

EXAMPLE 2

As in Example 1, a running test with a paper processing machine was performed using the following processing baths and procedures until the cumulative replenisher reached twice the color development tank capacity. Then, again as in Example 1, color development was carried out for 45, 90 or 135 seconds. The results were comparable to the results of Example 1.

| Processing Step | Temperature (°C.) | Time (sec) | Replenisher* (ml) | Tank Capacity (liter) |
|---|---|---|---|---|
| Color developer | 35 | 45 | 161 | 17 |
| Bleach-fix | 30-36 | 45 | 215 | 17 |
| Stabilization (1) | 30-37 | 20 | — | 10 |
| Stabilization (2) | 30-37 | 20 | — | 10 |
| Stabilization (3) | 30-37 | 20 | — | 10 |
| Stabilization (4) | 30-37 | 30 | 248 | 10 |
| Drying | 70-85 | 60 | | |

*: Replenisher per $m^2$ of the photosensitive material.
(A 4-tank countercurrent system of (4) to (1))

The composition of the respective processing solutions were as follows.

| Color developer | Tank Solution | Replenisher |
|---|---|---|
| Water | 800 ml | 800 ml |
| Ethylenediaminetetraacetic acid | 2.0 g | 2.0 g |
| 5,6-Dihydroxybenzene-1,2,4-trisulfonic acid | 0.3 g | 0.3 g |
| Triethanolamine | 8.0 g | 8.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| Diethylhydroxylamine | 4.2 g | 6.0 g |
| Fluorescent whitening agent (4,4'-diaminostilbene compound) | 2.0 g | 2.5 g |
| Water to make | 1,000 ml | 1,000 ml |
| pH (25° C.) | 10.05 | 10.45 |

Bleach fix bath
(the same for tank solution and replenisher)

| | |
|---|---|
| Water | 400 ml |
| Ammonium thiosulfate (70%) | 100 ml |
| Sodium sulfite | 17 g |
| Ammonium Fe(III) EDTA | 55 g |
| Disodium ethylenediaminetetraacetate | 5 g |
| Glacial acetic acid | 9 g |
| Water to make | 1,000 ml |
| pH (25° C.) | 5.40 |

Stabilizing bath
(the same for tank solution and replenisher)

| | |
|---|---|
| Formalin (37%) | 0.1 g |
| Formaldehyde-sulfurous acid adduct | 0.7 g |
| 5-Chloro-2-methyl-4-isothiazolin-3-one | 0.02 g |
| 2-Methyl-4-isothiazolin-3-one | 0.01 g |
| Copper sulfate | 0.005 g |
| Water to make | 1,000 ml |
| pH (25° C.) | 4.0 |

EXAMPLE 3

Using a support prepared by coating a polyethylene terephthalate substrate with a dispersion of titanium oxide in gelatin (coating amount of titanium oxide: 3.7 $g/m^2$), the same coating compositions as those prepared in Example 1 were coated in the same layer construction as in Example 1 to fabricate color photosensitive materials of the type that color photographs are viewed by transmitted light, as shown in Table 3. It should be understood that the coating amount was doubled for each of the first, third and fifth layers. The total silver coverage was 1.3 $g/m^2$.

The photographic characteristics of these samples were tested in the same manner as Example 1, except that the exposure time was 10 seconds. The change in color density was represented by the maximum color density of yellow, i.e., in the most slowly developed blue-sensitive layer. The results are set forth in Table 4. It is apparent from the data shown in the table that only when the photosensitive materials containing compounds (I) through (III) were processed for not less than 90 seconds, the change in sensitivity during storage after exposure was small and a color image of practically sufficient color density without occurrence of stain was obtained.

TABLE 3

| Sample | Compound Added to Third Layer (green-sensitive layer)* | Level of Addition ($g/m^2$) |
|---|---|---|
| 101 | — | — |
| 102 | Ia-31 | 0.05 |
| 103 | Ia-31 | 0.07 |
| 104 | Ia-31 | 0.20 |
| 105 | Ia-36 | 0.07 |
| 106 | IIa-5 | 0.07 |
| 107 | Ia-31 | 0.07 |
| | IIIa-1 | 0.04 |
| 108 | Ia-31 | 0.07 |
| | IIIa-31 | 0.04 |

*: Coemulsified with Solv-2, magenta coupler, Cpd-3 and Cpd-9.

TABLE 4

| Sample | Stain Developing Time 45 sec | 90 sec | 135 sec | Maximum Color Density of Yellow Developing Time 45 sec | 90 sec | 135 sec | Sensitivity of Exposed Samples after Storage at Room Temperature Developing Time 45 sec | 90 sec | 135 sec |
|---|---|---|---|---|---|---|---|---|---|
| 101 | 0.23 | 0.30 | 0.36 | 2.35 | 2.90 | 2.92 | 99 | 100 | 99 |
| 102 | 0.01 (0.22) | 0.01 (0.29) | 0.01 (0.35) | 2.35 | 2.90 | 2.91 | 82 | 100 | 101 |
| 103 | 0.00 (0.23) | 0.00 (0.30) | 0.00 (0.36) | 2.34 | 2.91 | 2.91 | 78 | 99 | 100 |
| 104 | 0.00 (0.23) | 0.00 (0.30) | 0.00 (0.36) | 2.34 | 2.90 | 2.91 | 75 | 98 | 98 |
| 105 | 0.01 (0.22) | 0.01 (0.29) | 0.01 (0.35) | 2.35 | 2.91 | 2.90 | 77 | 99 | 100 |
| 106 | 0.00 (0.23) | 0.00 (0.30) | 0.00 (0.36) | 2.34 | 2.91 | 2.90 | 75 | 98 | 99 |
| 107 | 0.00 (0.23) | 0.00 (0.30) | 0.00 (0.36) | 2.35 | 2.90 | 2.91 | 79 | 99 | 100 |
| 108 | 0.00 (0.23) | 0.00 (0.30) | 0.00 (0.36) | 2.34 | 2.90 | 2.90 | 76 | 100 | 101 |

Note:
The figures in the enclosures represent the test results substantiating the effect of the present invention. Each figure in parentheses denotes the magnitude of decrease in stain in the corresponding sample relative to Sample 101.

While the invention has been described in detail and with reference to specific embodiments thereof, it will be apparent to one skilled in the art that various changes and modifications can be made therein without departing from the spirit and scope thereof.

What is claimed is:

1. A method of forming a color image which comprises providing a silver halide color photographic material including a transparent support having thereon at least one photosensitive layer containing at least one coupler which forms a dye upon a coupling reaction with an oxidized product of an aromatic primary amine color developing agent and a substantially silver iodide-free silver halide emulsion containing at least 90 mol. % of silver chloride, which silver halide color photographic material further contains at least one compound of the following formula (I) or (II), and subjecting said silver halide color photographic material to imagewise exposure and then to development with a substantially benzyl alcohol-free developer for not less than 90 seconds;

$$R_{21}(A)_nX \qquad (I)$$

$$R_{22}-\underset{\underset{B}{|}}{C}=Y_1 \qquad (II)$$

wherein $R_{21}$ and $R_{22}$ each represents an aliphatic group, an aromatic group or a heterocyclic group; X represents a group which leaves on reaction with an aromatic amine developing agent; A represents a group which reacts with said aromatic amine developing agent to form a chemical bond; n is equal to 0 or 1; B represents hydrogen, an aliphatic group, an aromatic group, a heterocyclic group, an acyl group or a sulfonyl group; $Y_1$ represents a group which promotes addition of an aromatic amine developing agent to the compound of formula (II); and $R_{21}$ and X, and $Y_1$ and either $r_{22}$ or B may each combine to form a ring structure, wherein the silver halide color photographic material has a total silver coverage of not less than 1.2 g/m$^2$, and the compound of formulas (I) and (II) each is present in an amount of from $1\times10^{-2}$ to 10 moles per mol of magenta coupler.

2. A method of forming a color image as in claim 1, wherein the silver halide color photographic material contains at least one compound of the following formula (III):

$$R_{30}-Z \qquad (III)$$

wherein $R_{30}$ represents an aliphatic group, an aromatic group or a heterocyclic group; Z represents a nucleophilic group or a group which is decomposed in the photosensitive material to release a nucleophilic group, wherein the compound of formula (III) is present in an amount of from $1\times10^{-2}$ to 10 mols per mol of magenta coupler.

3. A method of forming a color image as in claim 1, wherein the compounds of formula (I) are represented by formulas (I-a), (I-b), (I-c) or (I-d) and whose second order reaction rate constant $K_2$ (80° C.) with respect to p-anisidine is within the range of $1\times10^{-1}$ liter/mol.s to $1\times10^{-5}$ liter/mol.s;

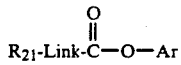
(I-a)

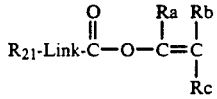
(I-b)

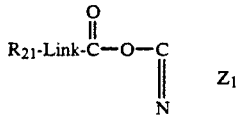
(I-c)

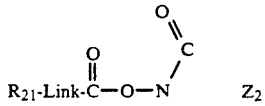
(I-d)

wherein $R_{21}$ represents an aliphatic group, an aromatic group or a heterocyclic group; Link represents a single bond or —O —; Ar represents an aromatic group; Ra, Rb and Rc each represents hydrogen or an aliphatic, aromatic heterocyclic group, alkoxy, aryloxy, heterocyclic oxy, alkylthio, arylthio, heterocyclic thio, amino, alkylamino, acyl, amido, sulfonamido, sulfonyl, alkoxycarbonyl, sulfo, carboxy, hydroxy, acyloxy, ureido, urethane, carbamoyl or sulfamoyl group; or Ra and Rb, Rb and Rc may link to form a 5- to 7-membered heterocyclic ring which may be further substituted, or form a spiro ring, a bicyclo ring or a fused ring which is condensed with an aromatic ring; $Z_1$ and $Z_2$ each represents a nonmetal atomic group necessary to form a 5- to 7-membered heterocyclic ring which may be further substituted or form a spiro ring, a bicyclo ring or a fused ring which is condensed with an aromatic ring.

4. A method of forming a color image as in claim 3, wherein the compound of formulas (I-a) to (I-d) each has a total number of carbon atoms of not less than 13.

5. A method of forming a color image as in claim 3, wherein the color photographic material contains at least one compound of formula (I-a) and whose second order reaction rate constant $K_2$ (80° C.) with respect to p-anisidine is within the range of $1\times10^{-1}$ liter/mol.s to $1\times10^{-5}$ liter/mol.s.

6. A method of forming a color image as in claim 2, wherein the compound of formula (III) is represented by formula (III-a):

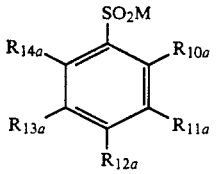

(III-a)

wherein M represents an atom or atomic group which forms an inorganic or organic salt,

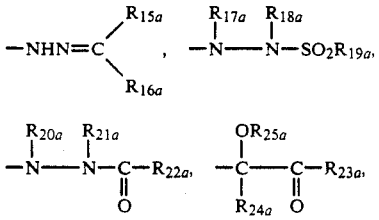

or hydrogen; $R_{15a}$ and $R_{16a}$, which may link to form a 5- to 7-membered ring, each represents hydrogen, an aliphatic group, an aromatic group or a heterocyclic group; $R_{17a}$, $R_{18a}$, $R_{20a}$ and $R_{21a}$ each represents hydrogen, an aliphatic group, an aromatic group, a heterocyclic group, an acyl group, an alkoxycarbonyl group, a sulfonyl group, a ureido group or a urethane group; provided that at least one of $R_{17a}$ and $R_{18a}$ and at least one of $R_{20a}$ and $R_{21a}$ are hydrogen; $R_{19a}$ represents hydrogen, an aliphatic group, an aromatic group, a heterocyclic group, an alkylamino group, an arylamino group, an alkoxy group, an aryloxy group, an acyl group, an alkoxycarbonyl group or an aryloxycarbonyl group; $R_{22a}$ represents hydrogen, an aliphatic group, an aromatic group or a heterocyclic group; at least two of $R_{17a}$, $R_{18a}$ and $R_{19a}$ may link to form a 5- to 7-membered ring, and at least two of $R_{20a}$, $R_{21a}$ and $R_{22a}$ may link to form a 5- to 7-membered ring; $R_{23a}$ represents hydrogen, an aliphatic group, an aromatic group or a heterocyclic group; $R_{24a}$ represents hydrogen, an aliphatic group, an aromatic group, a halogen, an acyloxy group or a sulfonyl group; $R_{25a}$ represents hydrogen or a hydrolyzable group; $R_{10a}$, $R_{11a}$, $R_{12a}$, $R_{13a}$ and $R_{14a}$ each represents hydrogen, an aliphatic group, an aromatic group, a heterocyclic group, a halogen

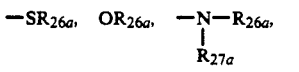

an acyl group, an alkoxycarbonyl group, an aryloxycarbonyl group, a sulfonyl group, a sulfonamido group, a sulfamoyl group, a ureido group, a urethane group, a carbamoyl group, a sulfo group, a carboxy group, a nitro group, a cyano group, an alkoxalyl group, an aryloxalyl group, a sulfonyloxy group

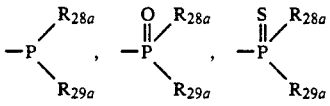

or a formyl group; $R_{26a}$ and $R_{27a}$ each represents hydrogen, an aliphatic group, an aromatic group, an acyl group or a sulfonyl group; $R_{28a}$ and $R_{29a}$ each represents hydrogen, an aliphatic group, an aromatic group, an alkoxy group or an aryloxy group; at least two of $R_{17a}$, $R_{18a}$ and $R_{19a}$ may link to form a 5- to 7-membered ring, and at least two of $R_{20a}$, $R_{21a}$ and $R_{22a}$ may link to form a 5- to 7-membered ring.

7. A method of forming a color image as in claim 6, wherein the total sum of Hammett o values of $R_{10a}$, $R_{11a}$, $R_{12a}$, $R_{13a}$ and $R_{14a}$ with respect to the $-SO_2M$ group is not less than 0.5.

8. A method of forming a color image as in claim 2, wherein the compounds of formulas (I), (II) or (III) are present in an amount of from $3\times10^{-2}$ to 5 mols, per mol of a magenta coupler.

9. A method of forming a color image as in claim 1, wherein the silver chloride content of the silver halide emulsion is not less than 95 mol. %.

* * * * *